US010682863B2

(12) United States Patent
Yamazaki et al.

(10) Patent No.: US 10,682,863 B2
(45) Date of Patent: Jun. 16, 2020

(54) LIQUID EJECTING APPARATUS AND CONTROL METHOD

(71) Applicant: CANON KABUSHIKI KAISHA, Tokyo (JP)

(72) Inventors: Takuro Yamazaki, Inagi (JP); Toru Nakakubo, Kawasaki (JP); Kazuhiro Yamada, Yokohama (JP); Yoshiyuki Nakagawa, Kawasaki (JP); Akiko Hammura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/006,312

(22) Filed: Jun. 12, 2018

(65) Prior Publication Data

US 2019/0001692 A1 Jan. 3, 2019

(30) Foreign Application Priority Data

Jun. 29, 2017 (JP) ..... 2017-127569

(51) Int. Cl.
*B41J 2/175* (2006.01)
*B41J 2/045* (2006.01)
(Continued)

(52) U.S. Cl.
CPC ..... *B41J 2/17566* (2013.01); *B41J 2/0452* (2013.01); *B41J 2/04525* (2013.01);
(Continued)

(58) Field of Classification Search
CPC .. B41J 2/17566; B41J 2/0452; B41J 2/04525; B41J 2/04543; B41J 2/04573;
(Continued)

(56) References Cited

U.S. PATENT DOCUMENTS 6,019,453 A 2/2000 Tsuruoka
9,931,845 B2 4/2018 Moriya et al.
(Continued)

FOREIGN PATENT DOCUMENTS

EP 1 260 371 A1 11/2002
EP 2 168 769 A1 3/2010
(Continued)

OTHER PUBLICATIONS

Extended European Search Report dated Oct. 30, 2018, in European Patent Application No. 18175938.2.
(Continued)

*Primary Examiner* — Jason S Uhlenhake
(74) *Attorney, Agent, or Firm* — Venable LLP

(57) ABSTRACT

In a configuration having a circulation flow path in association with an ejection element, a liquid ejecting apparatus is capable of circulating liquid suitably and maintaining stable ejection operation while reducing liquid vaporization, a power supply capacity, and the effect of noise. For this purpose, in a configuration in which liquid delivery mechanisms that facilitate a flow in a flow path are prepared in association with pressure chambers, the liquid delivery mechanisms are divided into a plurality of blocks and the liquid delivery mechanisms included in each of the blocks are driven at different timings.

12 Claims, 17 Drawing Sheets

(51) Int. Cl.

| | |
|---|---|
| ***B41J 29/02*** | (2006.01) |
| ***B41J 2/155*** | (2006.01) |
| ***B41J 2/18*** | (2006.01) |

(52) U.S. Cl.
CPC ..... *B41J 2/04543* (2013.01); *B41J 2/04573* (2013.01); *B41J 2/04581* (2013.01); *B41J 2/155* (2013.01); *B41J 2/175* (2013.01); *B41J 2/18* (2013.01); *B41J 29/02* (2013.01)

(58) Field of Classification Search
CPC ..... B41J 2/04581; B41J 2/155; B41J 2/175; B41J 2/18
See application file for complete search history.

(56) References Cited

U.S. PATENT DOCUMENTS

| | | | | |
|---|---|---|---|---|
| 2007/0200885 | A1* | 8/2007 | Hibi | B41J 2/0452 347/11 |
| 2011/0228012 | A1* | 9/2011 | Yoshida | B41J 2/14274 347/68 |
| 2013/0176357 | A1* | 7/2013 | Yasutani | B41J 2/0454 347/17 |
| 2016/0368273 | A1 | 12/2016 | Ishikawa | |
| 2017/0197419 | A1 | 7/2017 | Okushima et al. | |
| 2017/0197439 | A1 | 7/2017 | Okushima et al. | |
| 2017/0274647 | A1 | 9/2017 | Aoki et al. | |

FOREIGN PATENT DOCUMENTS

| | | | |
|---|---|---|---|
| JP | 06-198893 | A | 7/1994 |
| JP | 2511583 | Y2 | 9/1996 |
| JP | 2017-001374 | A | 1/2017 |
| WO | 2016/068987 | A1 | 5/2016 |

OTHER PUBLICATIONS

U.S. Appl. No. 15/976,470, Kazuhiro Yamada, Toru Nakakubo, Yoshiyuki Nakagawa, Shingo Okushima, filed May 10, 2018.
U.S. Appl. No. 15/992,667, Takuro Yamazaki, Toru Nakakubo, Kazuhiro Yamada, Yoshiyuki Nakagawa, Yoshihiro Hamada, Koichi Ishida, Shingo Okushima, filed May 30, 2018.
U.S. Appl. No. 15/995,493, Toru Nakakubo, Takuro Yamazaki, Kazuhiro Yamada, Yoshiyuki Nakagawa, filed Jun. 1, 2018.
U.S. Appl. No. 16/014,600, Akiko Hammura, Yoshiyuki Nakagawa, filed Jun. 21, 2018.
Office Action dated Jan. 17, 2020, in European Patent Application No. 18 175 938.2.
Office Action dated Mar. 24, 2020, in Chinese Patent Application No. 201810722346.0.

* cited by examiner

UNIT ml/min

| TEMPERATURE / HUMIDITY | 25℃ | 50℃ | 75℃ |
|---|---|---|---|
| 50% | $8.7 \times 10^{-5}$ | $6.1 \times 10^{-4}$ | $1.3 \times 10^{-3}$ |
| 30% | $1.7 \times 10^{-4}$ | $1.5 \times 10^{-3}$ | $3.7 \times 10^{-3}$ |
| 10% | $3.5 \times 10^{-4}$ | $2.9 \times 10^{-3}$ | $6.4 \times 10^{-3}$ |

LIQUID EJECTING APPARATUS AND CONTROL METHOD

BACKGROUND OF THE INVENTION

Field of the Invention

The present invention relates to a liquid ejecting apparatus and a control method thereof.

Description of the Related Art

In a liquid ejection module such as an inkjet print head, evaporation of a volatile component progresses in an ejection port in which no ejection operation is performed for a while, which may lead to deterioration of ink (liquid). This is because the evaporation of the volatile component increases the concentration of a component such as a color material and, if the color material is pigment, causes coagulation or sedimentation of the pigment, thereby affecting an ejection state. More specifically, the amount and direction of ejection are varied and an image thus includes density unevenness or a stripe.

In order to suppress such ink deterioration, a method of circulating ink in a liquid ejection module and supplying flesh ink regularly to ejection ports has been recently proposed. International Laid-Open No. WO 2016/068987 discloses a method of providing a liquid delivery mechanism (pump element) in a circulation flow path that supplies ink to each ejection port and controlling driving intervals of ejection elements and the pump element.

SUMMARY OF THE INVENTION

According to a first aspect of the present invention, there is provided a liquid ejecting apparatus comprising: a pressure chamber which stores liquid; an energy generating element which provides energy to liquid in the pressure chamber; an ejection port from which liquid provided with energy by the energy generating element is ejected; a liquid delivery mechanism which is prepared in association with the pressure chamber and facilitates a flow of liquid through the pressure chamber; and a control unit configured to control driving of a plurality of the liquid delivery mechanisms, wherein the control unit divides the plurality of the liquid delivery mechanisms into a plurality of blocks and drives the liquid delivery mechanisms included in each of the blocks at different timings.

According to a second aspect of the present invention, there is provided a control method of a liquid ejecting apparatus, the liquid ejecting apparatus comprising a pressure chamber which stores liquid; an energy generating element which provides energy to liquid in the pressure chamber; an ejection port from which liquid provided with energy by the energy generating element is ejected; and a liquid delivery mechanism which is prepared in association with the pressure chamber and facilitates a flow of liquid through the pressure chamber, wherein a plurality of the liquid delivery mechanisms are divided into a plurality of blocks and the liquid delivery mechanisms included in each of the blocks are driven at different timings.

Further features of the present invention will become apparent from the following description of exemplary embodiments with reference to the attached drawings.

DESCRIPTION OF THE EMBODIMENTS

In International Laid-Open No. WO 2016/068987, although the optimization for each of circulation flow paths corresponding to respective ejection ports is taken into account, consideration is not given to the entire circulation flow path including a number of ejection ports. As a result, a problem described below has occurred.

In a configuration having a number of ejection elements like a full line type inkjet print head, an imbalance between ejection frequencies of ejection elements increases variations in the degrees of ink evaporation and deterioration in a print head. On the other hand, if ink is circulated sufficiently to avoid ink deterioration in all ejection elements, a frequency of exposing liquid to the atmosphere through the ejection ports becomes high, with the result that the amount of vaporization of circulating ink as a whole is increased more than necessary.

Further, if a number of liquid delivery mechanisms are driven simultaneously, a large current flows per unit time, which requires a large power supply capacity and leads to an increase in cost. In addition, there is a possibility that a drive pulse to be applied to the liquid delivery mechanisms affects a drive pulse to be applied to the ejection elements and the effect of noise appears in ejection operation.

The present invention has been accomplished in order to solve the problem described above. Accordingly, an object of the present invention is to provide a liquid ejecting apparatus capable of circulating liquid suitably and maintaining stable ejection operation while suppressing liquid vaporization, a power supply capacity, and the effect of noise in a configuration of having a circulation flow path in correspondence with ejection elements.

(First Embodiment)

Figure 1:
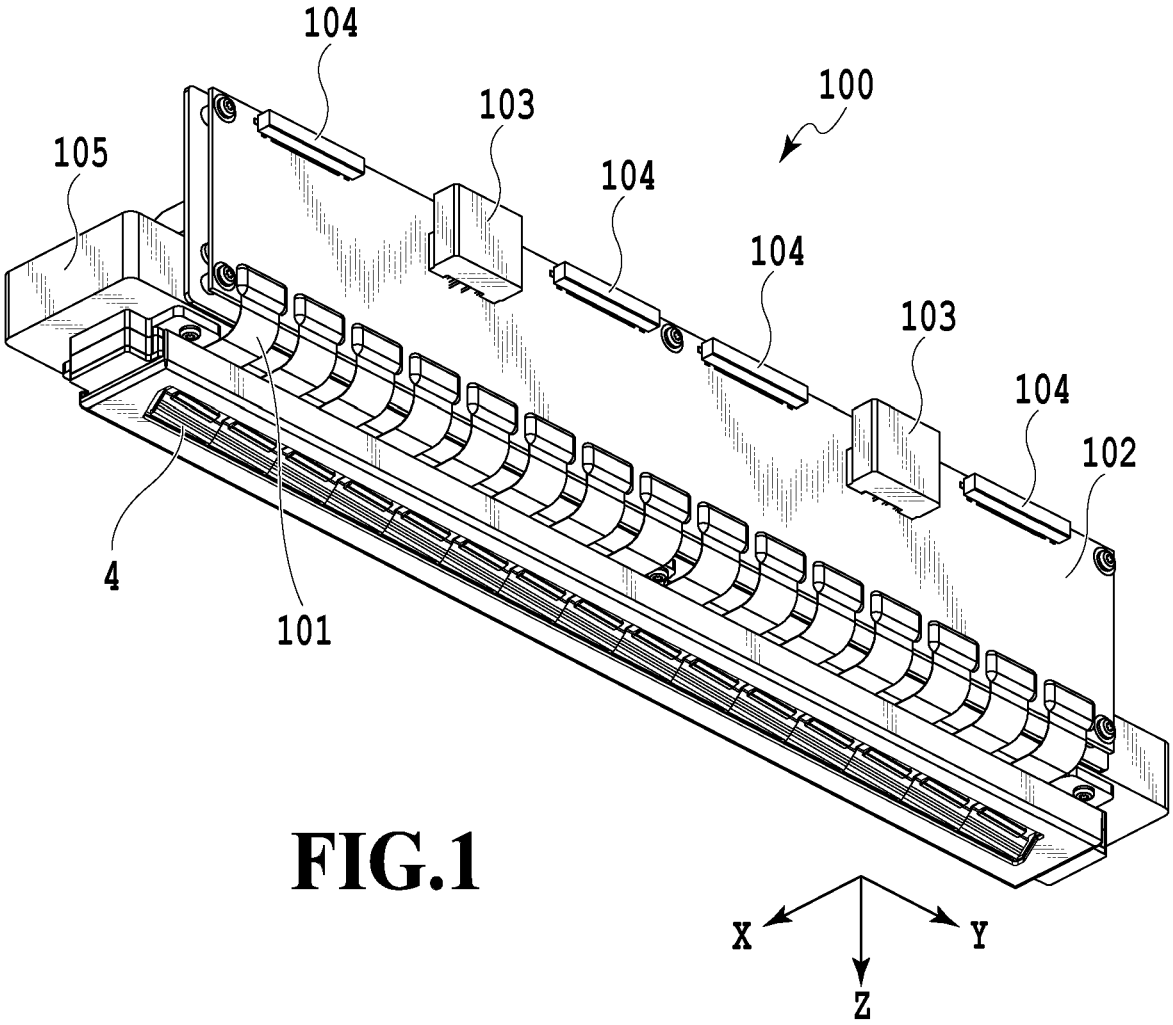
FIG. 1 is a perspective view of an inkjet print head.

FIG. 1 is a perspective view of an inkjet print head 100 (hereinafter also simply referred to as a print head) that can be used in a liquid ejecting apparatus of the present invention. The print head 100 has a plurality of printing element substrates 4 arrayed in a Y direction, each printing element substrate 4 having a plurality of printing elements arrayed in the Y direction. FIG. 1 shows a full line type print head 100 in which printing element substrates 4 are arrayed in the Y direction by a distance corresponding to the width of an A4 size.

The printing element substrates 4 are connected to the same electric wiring board 102 through flexible wiring boards 101. The electric wiring board 102 is equipped with power supply terminals 103 for accepting power and signal input terminals 104 for receiving ejection signals. An ink supply unit 105 has a circulation flow path that supplies ink from an unshown ink tank to each printing element substrate 4 and collects ink not consumed by printing.

With the configuration described above, each printing element provided on the printing element substrate 4 uses power supplied from the power supply terminals 103 to eject ink supplied from the ink supply unit 105 in a Z direction in the drawings based on ejection signals input from the signal input terminals 104.

Figure 2A:
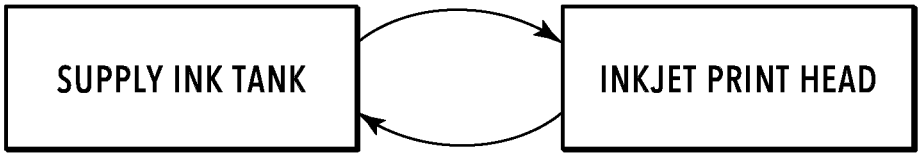
FIGS. 2A and 2B are conceptual diagrams of ink circulation adoptable in the present invention.
Figure 2B:
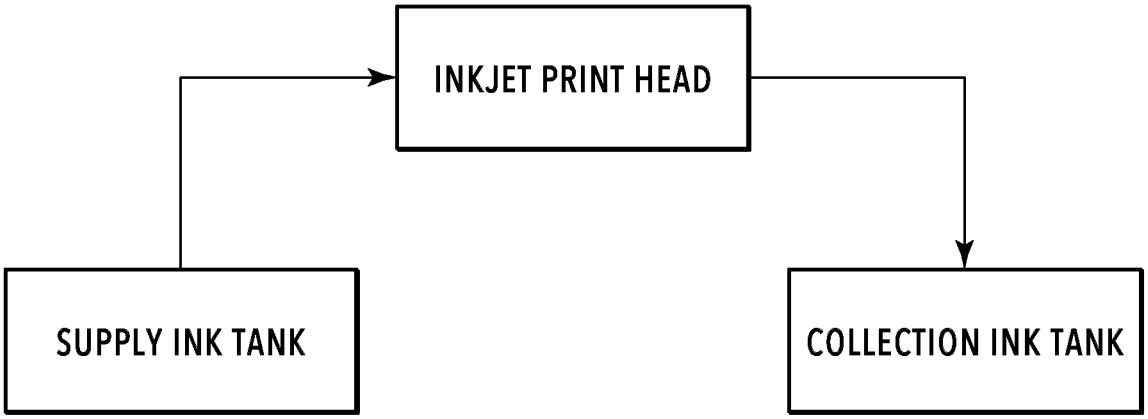

FIGS. 2A and 2B are conceptual diagrams of ink circulation adoptable in the present embodiment. FIG. 2A shows a configuration in which ink is circulated between a supply ink tank and the inkjet print head. Ink supplied from the supply ink tank to the print head is partly consumed by ejection operation of the print head and ink not consumed by the ejection operation is collected into the supply ink tank again. In a case where the collected ink is deteriorated by evaporation of a volatile component in the print head 100, the supply ink tank may have the function of adjusting components of the collected ink.

FIG. 2B shows a configuration in which a supply ink tank and a collection ink tank are separately provided. Ink supplied from the supply ink tank to the print head is partly consumed by ejection operation of the print head and ink not consumed by the ejection operation is collected into the collection ink tank. Providing a unit that adjusts ink components of the ink collected into the collection ink tank makes it possible to return the ink after adjustment to the supply ink tank. Both the configurations may be applied to the liquid ejecting apparatus of the present embodiment.

Figure 3:
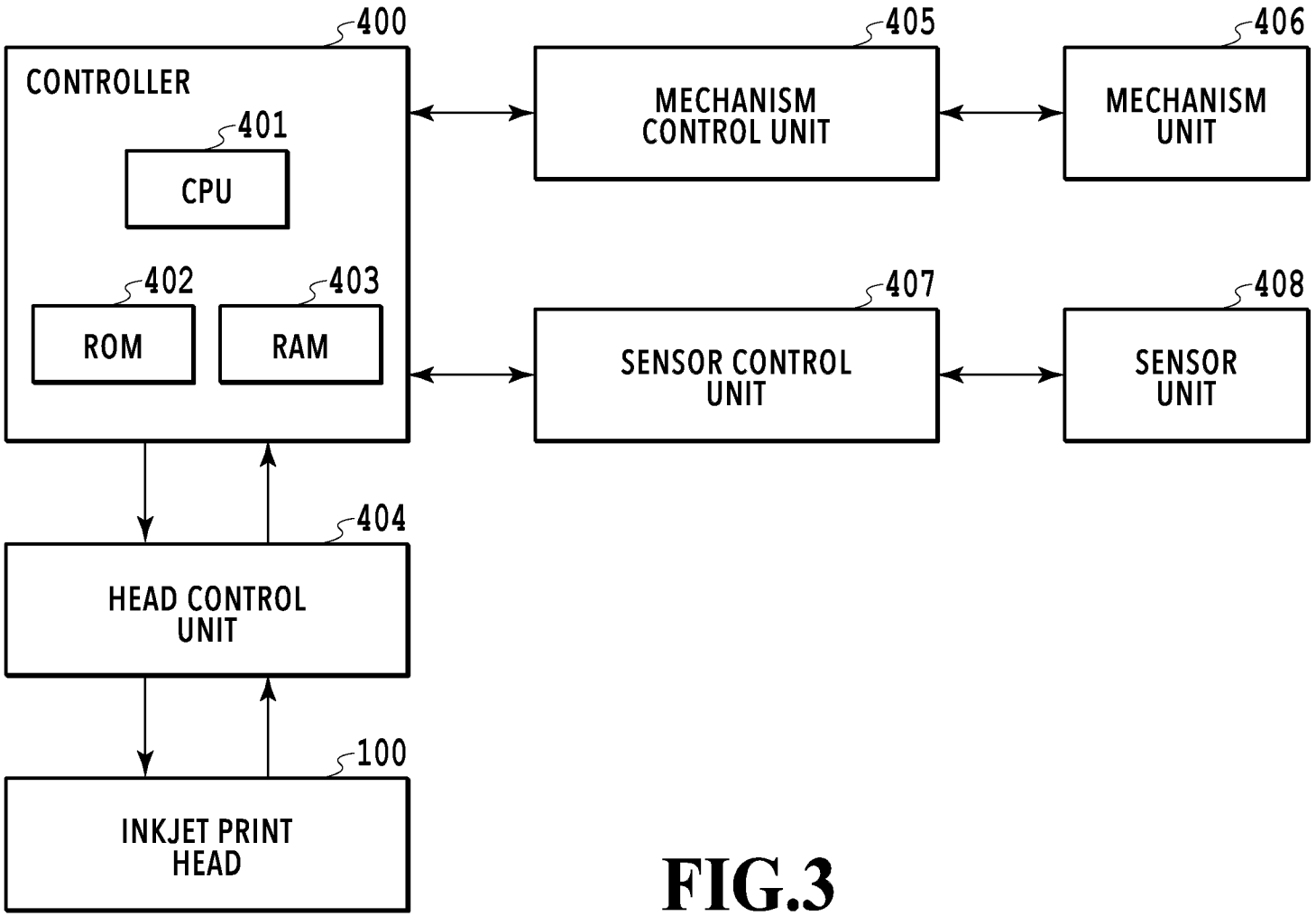
FIG. 3 is a block diagram illustrating a control configuration in a liquid ejecting apparatus.

FIG. 3 is a block diagram illustrating a control configuration in the liquid ejecting apparatus. A controller 400 comprises a CPU 401, a ROM 402, and a RAM 403. The CPU 401 controls the entire apparatus based on programs and parameters stored in the ROM 402 by using the RAM 403 as a work area.

A head control unit 404 controls the inkjet print head 100. To be more specific, the head control unit 404 drives a liquid delivery mechanism provided in the print head 100 to circulate ink in the print head and drives an energy generating element to perform ejection operation under instructions from the CPU 401. Specific control performed by the head control unit 404 will be described later in detail.

A mechanism unit 406 includes, for example, a conveyance mechanism for conveying a print medium and a maintenance mechanism for performing maintenance of the print head 100. The mechanism unit 406 also includes a pump for circulating ink in the print head 100, a negative pressure control unit for controlling a pressure (negative pressure) in the flow path, and a valve for opening and closing the flow path. A mechanism control unit 405 controls all the mechanisms under instructions from the CPU 401.

A sensor unit 408 includes various sensors for confirming an environment where the apparatus is placed and the states of the apparatus at different times, such as a temperature sensor, a humidity sensor, and a sensor that detects a sheet feeding state. The sensor unit 408 also includes a diode sensor for detecting a substrate temperature of the print head 100 and a sensor for detecting a fluid pressure in ink circulating in the print head 100. A sensor control unit 407 provides detection results obtained from the sensors to the CPU 401. The CPU 401 drives the mechanism unit 406 and print head 100 based on the information obtained from the sensors.

Figure 4A:
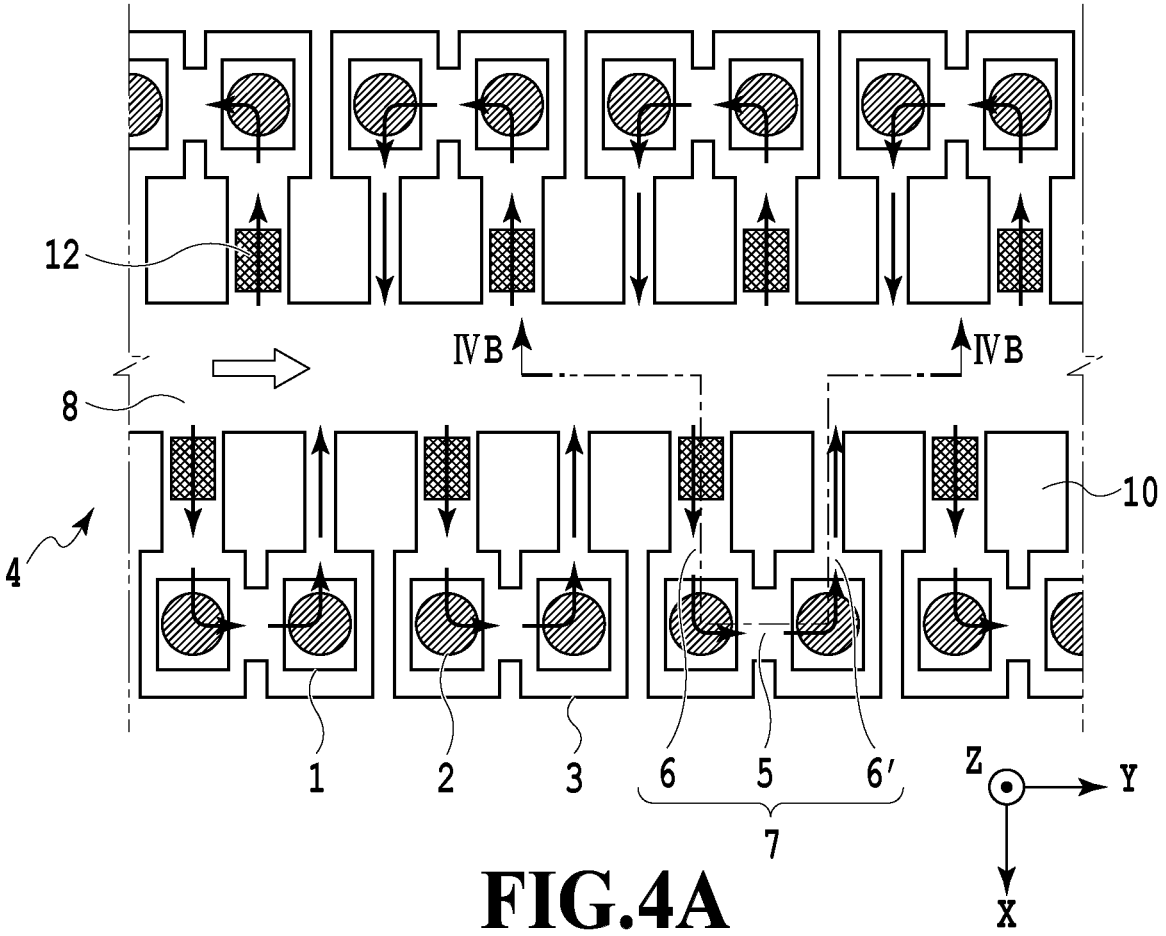
FIGS. 4A and 4B are diagrams showing a flow path configuration of a printing element substrate in a first embodiment.
Figure 4B:
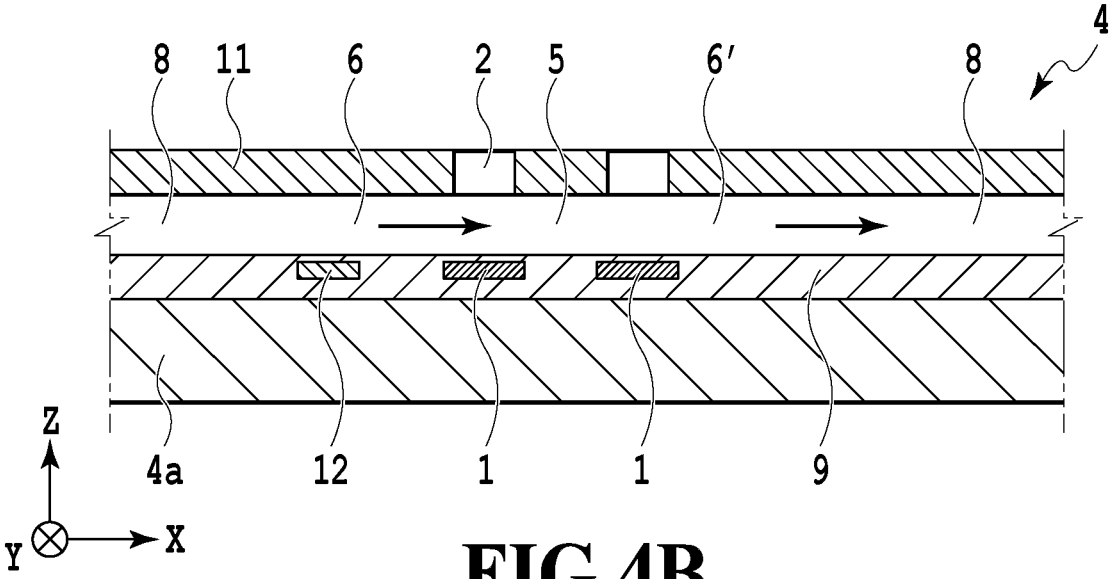

FIGS. 4A and 4B are diagrams showing a flow path configuration of the printing element substrate 4. FIG. 4A is a perspective view of the printing element substrate 4 from the side of ejection ports (+Z side) and FIG. 4B is a cross-sectional view. As shown in FIG. 4A, a pressure difference produced by an unshown pump causes ink to flow through the supply flow path 8 in a +Y direction. Ink flowing in the +Y direction partly flows into individual flow paths 7 provided on both sides of the supply flow path 8 and then returns to the supply flow path 8. Two pressure chambers 3 are provided in the midstream of each individual flow path 7.

Two connection flow paths 6 and 6' connecting the two pressure chambers 3 to the supply flow path 8 have different widths in the Y direction. A difference in flow path resistance produces a unidirectional flow. In each individual flow path 7, the connection flow path 6, which is located upstream and has a wide width, has a liquid delivery mechanism 12 for accelerating a flow of liquid. With the configuration described above, a flow is produced in each individual flow path 7 so that liquid flows from the supply flow path 8 to the first pressure chamber 3 through the wide connection flow path 6, flows into the second pressure chamber 3 through a communication flow path 5, and returns to the supply flow path 8 through the narrow connection flow path 6'. The deterioration of ink near ejection ports 2 can be suppressed by controlling the flow in each individual flow path 7 together with the flow in the +Y direction in the supply flow path 8.

Although not shown in the drawing, it is preferable that a filter is provided in the midstream of the connection flow path 6 to prevent foreign matter, bubbles and the like from flowing therein. For example, a columnar structure can be used as the filter.

FIG. 4B is a cross-sectional view taken along line IVB-IVB in FIG. 4A. The printing element substrate 4 is obtained by stacking a functional layer 9, a flow path forming member 10, and an ejection port forming member 11 in this order on a substrate 4*a* of silicon or the like. The supply flow path 8, individual flow path 7, and communication flow path 5 are formed on the same plane by a flow path wall of the flow path forming member 10.

Energy generating elements 1 are provided in positions corresponding to the pressure chambers 3 on the functional layer 9. Ejection ports 2 are formed in positions corresponding to the energy generating elements 1 in the ejection port forming member 11. Upon application of a voltage pulse to the energy generating elements 1 based on an ejection signal, film boiling occurs in ink contacting the energy generating elements 1 and the growth energy of produced bubbles ejects ink as droplets from the ejection ports 2 in the Z direction. In the present embodiment, a combination of the ejection port 2, the energy generating element 1, and the pressure chamber 3 is referred to as a printing element (ejection element).

In each individual flow path 7, the liquid delivery mechanism 12 is provided in a position corresponding to the connection flow path 6, which is located upstream and has a wide width, on the functional layer 9. The flow in the individual flow path 7 is accelerated by driving the liquid delivery mechanism 12 based on a drive signal.

Specific examples of the dimensions of the above structure are explained below. The size of the energy generating element 1 is 25 μm×30 μm, the diameter of the ejection port 2 is 25 μm, and the area of the pressure chamber 3 is 30 μm×35 μm. The upstream connection flow path 6 has a width of 20 μm and a length of 40 μm, the downstream connection flow path 6' has a width of 10 μm and a length of 40 μm, the communication flow path 5 has a width of 20 μm and a length of 10 μm, and the whole of the individual flow path 7 has a height of 20 μm. The width of the supply flow path 8 is 50 μm and the thickness of the ejection port forming member 11 is 20 μm. The viscosity of ink to be used is 2 cP and the amount of ink ejection from each ejection port is 10 pl.

In the printing element substrate 4 of the present embodiment, printing elements are arrayed in the Y direction with a pitch of 600 dpi (dots per inch). Two printing element arrays on respective sides of the supply flow path 8 are shifted from each other in the Y direction by half the pitch. As a consequence, an image can be printed at a resolution of 1200 dpi on a print medium that is conveyed in an X direction at a predetermined speed.

Figure 7:
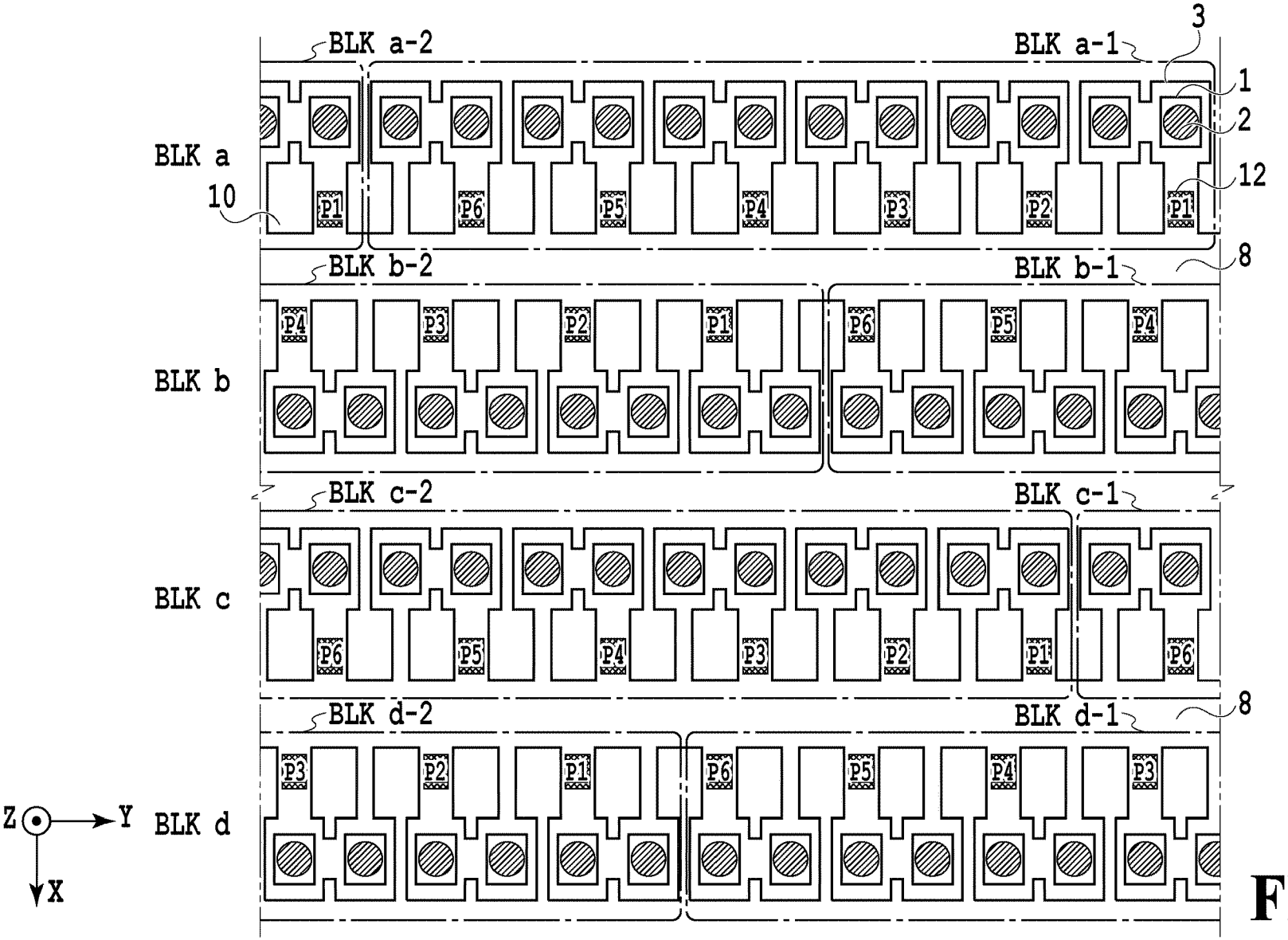
FIG. 7 is a diagram showing a state where a plurality of liquid delivery mechanisms are divided into blocks.

Although FIG. 4A shows one supply flow path 8 and two printing element arrays located on respective sides of the supply flow path 8, the printing element substrate of the present embodiment further includes another printing element group shown in FIG. 4A in the X direction to eject the same type of ink (see FIG. 7). That is, a pixel array having one pixel width of 1200 dpi and extending in the X direction can be printed by ejection operation using two printing elements alternately or in a predetermined order. In a case where the liquid ejecting apparatus of the present embodiment is a color inkjet printing apparatus, groups of four printing element arrays ejecting the same type of ink are further arrayed in the X direction in a number corresponding to the number of ink colors.

As the liquid delivery mechanism 12 of the present embodiment, an alternating current electro-osmotic (ACEO) pump, an actuator or the like may be used. In the case of using an actuator, various actuators such as a piezoelectric actuator, an electrostatic actuator, and a mechanical/impact actuator may be used. In the description below, a case of using a piezoelectric actuator as the liquid delivery mechanism 12 will be taken as an example.

Figure 5:
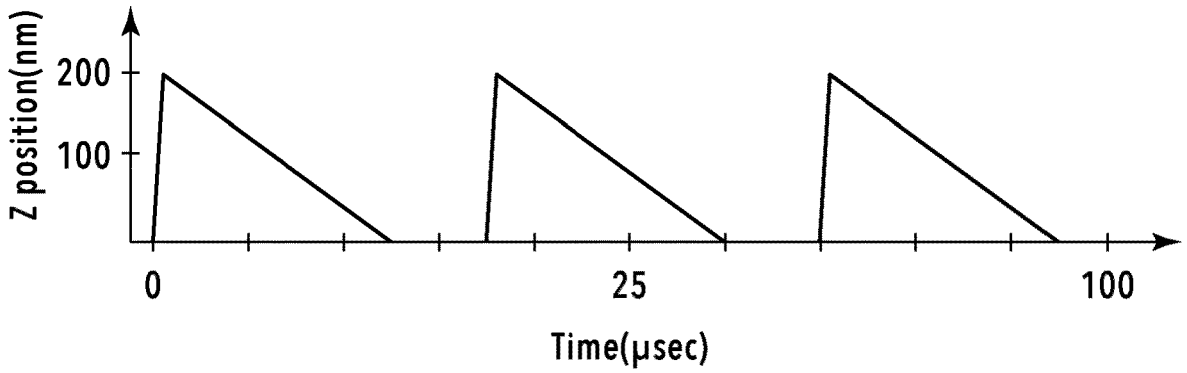
FIG. 5 shows an example of driving in the case of using a piezoelectric actuator as a liquid delivery mechanism.

FIG. 5 shows an example of driving in the case of using a piezoelectric actuator as the liquid delivery mechanism 12. The horizontal axis indicates time and the vertical axis indicates displacement of the piezoelectric actuator. A voltage is applied to the piezoelectric actuator, whereby the piezoelectric actuator protrudes in the flow path and narrows the connection flow path 6. After the application of the voltage is stopped, the piezoelectric actuator gradually moves down and restores the connection flow path 6 to an original volume. In such a manner, the displacement of the actuator asymmetric with respect to time and the difference in flow path resistance between the connection flow paths 6 and 6' allow ink to flow through the individual flow path 7 in the direction shown in FIGS. 4A and 4B. In the present embodiment, one liquid delivery operation is performed by applying a voltage three times in 100 μsec to displace the actuator three times as shown in FIG. 5.

Figure 6:
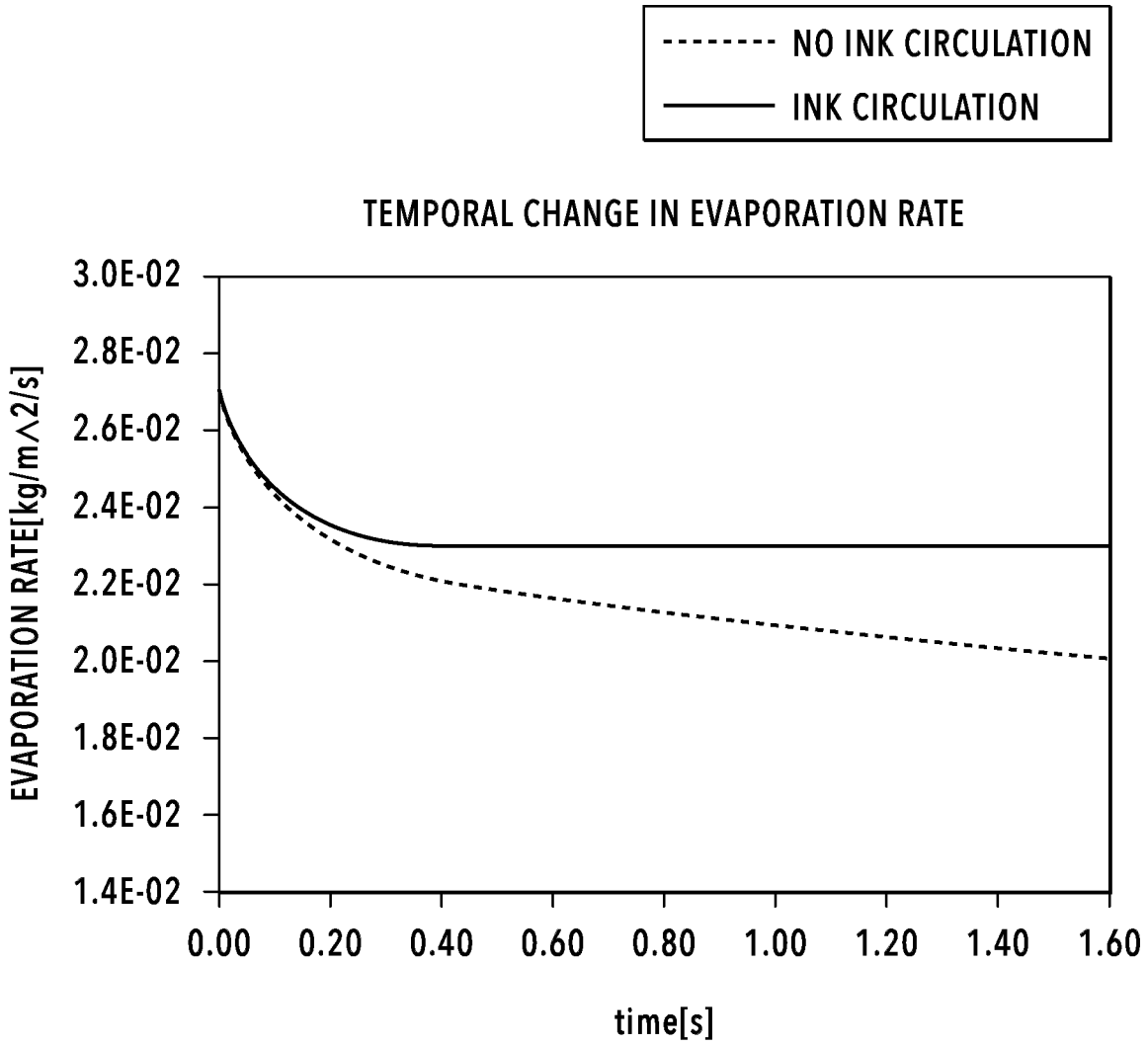
FIG. 6 is a diagram comparing ink evaporation rates from ejection ports.

FIG. 6 is a diagram comparing ink evaporation rates from the ejection ports in the case of circulating ink and in the case of not circulating ink. The horizontal axis indicates time elapsed since the ejection ports were opened by removing a cap from the print head 100. The vertical axis indicates an ink evaporation rate from the ejection ports (the amount of evaporation per unit time and unit area).

In the case of not circulating ink, if a volatile component of ink is evaporated from the ejection ports to some extent, concentration of ink staying near the ejection ports progresses. The concentrated ink interferes with the evaporation of ink inside the ejection ports, thereby gradually decreasing the evaporation rate of ink as a whole. In contrast, in the case of circulating ink, a high ink evaporation rate is maintained because fresh ink is regularly supplied to the ejection ports 2 and the pressure chambers 3. More specifically, the evaporation rate is stabilized at a value at which an evaporation rate from the ejection ports 2 is in proportion to a rate of replacement of ink with fresh ink corresponding to an ink flow rate in the individual flow paths 7. That is, in the case of circulating ink, it is possible to regularly prepare ink that is not completely fresh but is prevented from being concentrated or deteriorated to some extent near the ejection ports 2.

However, if all the liquid delivery mechanisms 12 are driven simultaneously for the circulation described above, a large current temporarily flows. This creates a need to secure a sufficient power supply capacity for the liquid delivery mechanism 12 in the liquid ejecting apparatus and may result in an increase in cost. Further, with the configuration in which the energy generating elements 1 and the liquid delivery mechanisms 12 are arrayed at high density on the same plane like the present embodiment, since lines for supplying power to them are also provided densely and intricately, there is a possibility that drive signals for the energy generating elements 1 include noise. In consideration of such a situation, in the present embodiment, the liquid delivery mechanisms 12 arrayed on the same printing element substrate 4 are divided into a plurality of blocks and are driven per block.

FIG. 7 is a diagram showing a state where the liquid delivery mechanisms 12 are divided into blocks. FIG. 7 shows a layout of printing element groups, supply flow paths 8, and individual flow paths 7 for one color. Printing element arrays are provided on both sides of each of the two supply flow paths 8 extending in the Y direction, that is, four printing element arrays are provided in total. FIG. 7 shows the four printing element arrays as BLKa, BLKb, BLKc, and BLKd.

In the present embodiment, each individual flow path 7 is equipped with one liquid delivery mechanism 12. In each printing element array, the liquid delivery mechanisms 12 are divided into blocks each including six consecutive liquid delivery mechanisms 12 and twelve consecutive printing elements. Driving is controlled per block. FIG. 7 shows six liquid delivery mechanisms included in the same block as P1 to P6 (also referred to as pump 1 to pump 6). The division is made so that the four printing element arrays BLKa, BLKb, BLKc, and BLKd include the boundaries between adjacent blocks in different positions in the Y direction. More specifically, the printing element arrays BLKa and BLKb, to which ink is supplied from the same supply flow path 8, are shifted from each other in the Y direction by half a cycle (corresponding to three liquid delivery mechanisms).

The printing element arrays BLKc and BLKd are also shifted from each other in the same manner.

Figure 8:
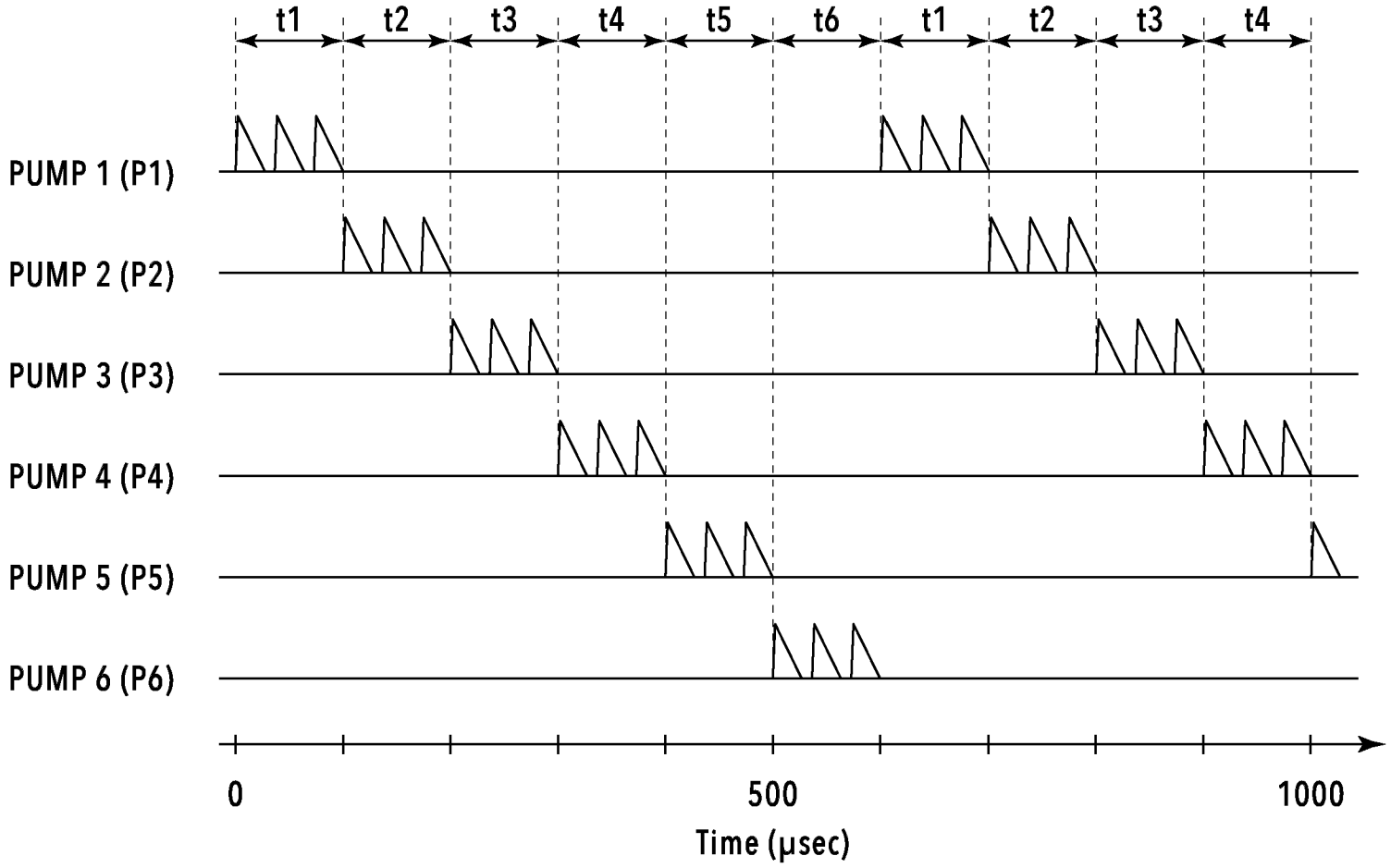
FIG. 8 is a timing chart of block driving.

FIG. 8 is a timing chart of block driving. The liquid delivery operation of performing driving three times in 100 μsec illustrated in FIG. 5 is performed sequentially for the liquid delivery mechanisms of P1 to P6 (pump 1 to pump 6). In this example, one-sixth of the liquid delivery mechanisms 12 provided on the printing element substrate 4 is simultaneously driven, thereby preventing cost from being increased more than necessary by a large power supply capacity.

As shown in FIG. 7, the positions of liquid delivery mechanisms 12 that are simultaneously driven, that is, the positions of liquid delivery mechanisms each of P1, P2, P3, P4, P5, or P6, are dispersed substantially uniformly on the XY plane of the printing element substrate 4. In other words, simultaneous driving is performed exclusively for liquid delivery mechanisms that are uniformly dispersed. Accordingly, noise in a drive signal for each energy generating element 1 can be sufficiently reduced and a high degree of driving controllability can be maintained.

Further, for each liquid delivery mechanism 12, the liquid delivery operation is repeated intermittently in a period of 600 μsec. Consequently, ink flows constantly and gently through the entire circulation flow path including the supply flow paths 8 and is replaced with fresh ink not more frequently than necessary in the entire print head and each ejection port. As a result, the evaporation amount of ink as a whole is not increased more than necessary and can be reduced to the extent that ink is not deteriorated, and stable ejection operation can be maintained.

(Second Embodiment)

In the present embodiment, the same print head as that of the first embodiment is used and divisional driving of liquid delivery mechanisms is performed in the same manner as the first embodiment. In addition, in the present embodiment, the driving amounts of the liquid delivery mechanisms are adjusted together or separately on various conditions.

Figures 9A, 9B:
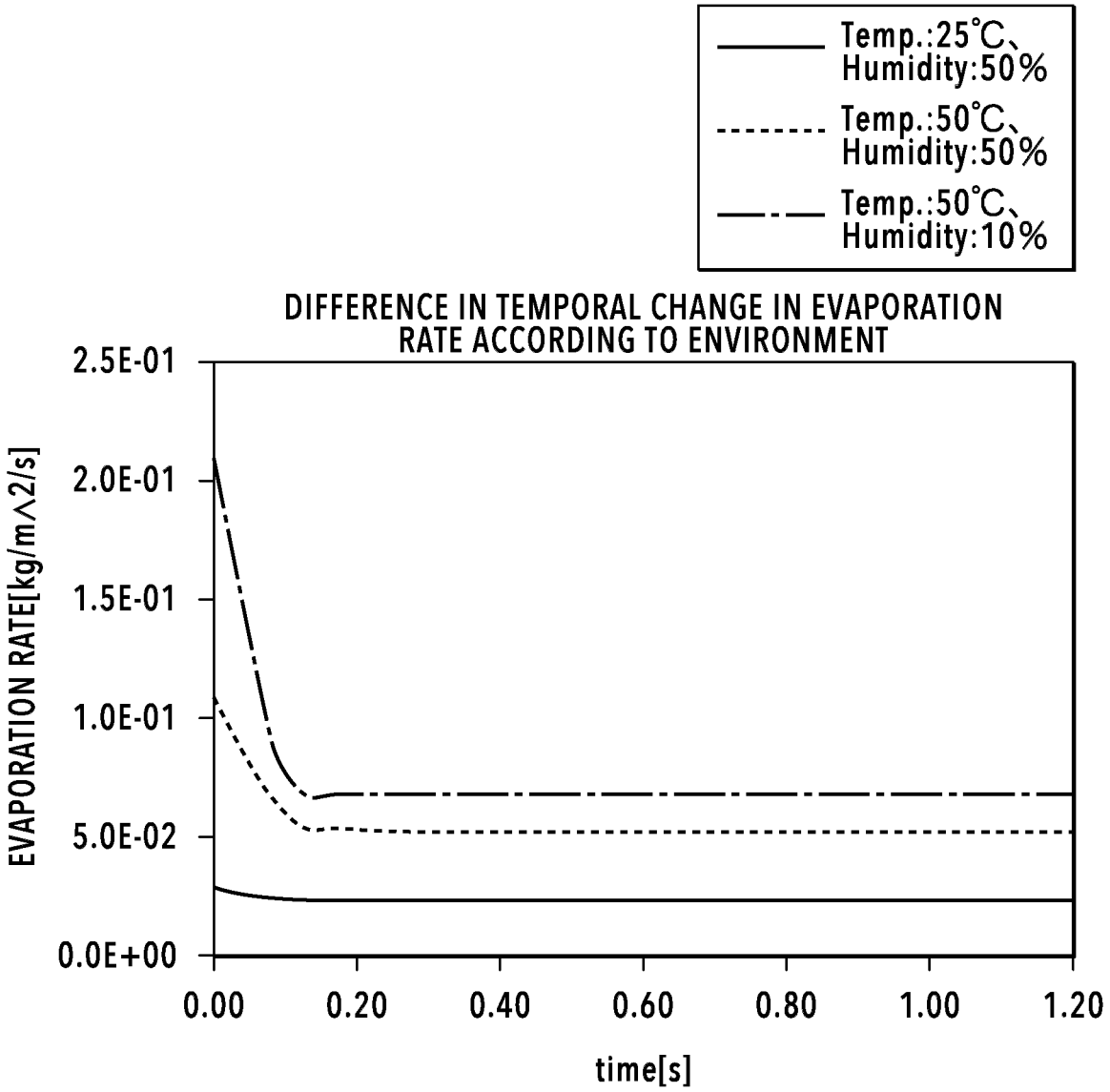
FIGS. 9A and 9B are diagrams showing a difference in evaporation rate according to the temperature and humidity of an environment.

FIGS. 9A and 9B are diagrams showing a difference in evaporation rate according to the temperature and humidity of an environment where the printing apparatus is placed. FIG. 9A shows evaporation rates (evaporation volumes per unit time and unit area) at the time of opening the ejection ports in association with three stages of each of the ambient temperature and humidity. FIG. 9A shows that as the temperature increases and the humidity decreases, the evaporation rate becomes higher.

FIG. 9B is a graph comparing changes in evaporation rate from the time of opening the ejection ports in three environments (25° C./50%, 50° C./50%, and 50° C./10%) in the case of circulating ink in the method of the first embodiment. The evaporation rate converges to a certain value with time on each condition, but the convergence value is different depending on the environment where the apparatus is placed. As a result, the degrees of concentration and deterioration of ink near the ejection ports are also different depending on the environment where the apparatus is placed.

In light of the situation described above, in the present embodiment, the driving amounts of all the liquid delivery mechanisms 12 are adjusted based on combinations of the ambient temperature and humidity while performing the same divisional driving as that in the first embodiment. To be more specific, in an environment where the evaporation rate is relatively high, the liquid delivery mechanisms 12 are driven three times in one liquid delivery operation as shown in FIG. 5. As the evaporation rate becomes lower, the number of times of driving of the liquid delivery mechanisms 12 in one liquid delivery operation is reduced or the period of the liquid delivery operation is doubled (1200 μsec).

For example, in the case of three environments shown in FIG. 9B, the liquid delivery mechanisms 12 are driven three times at 50° C./10%, twice at 50° C./50%, and once at 25° C./50% in one liquid delivery operation, whereby the evaporation rates can be close to each other.

The driving control of the liquid delivery mechanisms 12 described above is performed by the controller 400 for the inkjet print head 100 via the head control unit 404 (see FIG. 3). More specifically, it is only necessary to prestore, in the ROM 402, a table in which combinations of the ambient temperature and humidity are associated with the number of times of driving and a driving period of the liquid delivery mechanism 12. The CPU 401 acquires detection values of the temperature and humidity sensors of the sensor unit 408 and acquires, from the table stored in the ROM 402, the number of times of driving and driving period of the liquid delivery mechanism 12 corresponding to the detection values. The liquid delivery mechanisms 12 of the print head 100 can be driven based on the acquired number of times of driving and driving period.

In this manner, even if the environment where the printing apparatus is placed is variously changed, stable ejection operation can be maintained while reducing the ink evaporation amount of the entire print head to the extent that ink is not deteriorated. In the above description, the number of times of driving is controlled based on both the ambient temperature and humidity. However, the advantageous result of avoiding ink from evaporating more than necessary can be produced even if the control is performed based on only the ambient temperature or the ambient humidity. Further, the degree of ink evaporation is affected by the temperature of the printing element substrate 4 as well as the ambient temperature. Thus, a detection value of the diode sensor provided on the printing element substrate 4 may be acquired in place of or in addition to the detection value of the ambient temperature sensor so that the number or times of driving or driving period is controlled based on the acquired value(s).

Further, the evaporation rate from the ejection ports is affected not only by the temperature and humidity described above but also by a flow rate of ink flowing through the common flow paths 8. As the flow rate of ink flowing through the supply flow paths 8 increases, a flow rate in the individual flow paths 7 becomes higher and ink evaporation from the ejection ports 2 is facilitated. Thus, the number of times of driving and driving period of the liquid delivery mechanisms 12 may be changed according to the flow rate in the common flow paths 8 in order to prevent ink from evaporating more than necessary.

In this case, the CPU 401 acquires a detection value of a flow rate sensor that detects the flow rate in the supply flow paths 8 and acquires the number of times of driving or driving period of the liquid delivery mechanisms 12 corresponding to the detection value from the table prestored in the ROM 402, in which the flow rate is associated with the number of times of driving or driving period. The liquid delivery mechanisms 12 of the print head 100 can be driven based on the acquired number of times of driving or driving period.

The degree of ink concentration in each ejection port is also affected by an ejection frequency in the ejection port. Since ink concentration progresses near an ejection port having a low ejection frequency, it is necessary to circulate ink actively before the next ejection. In contrast, in an ejection port having a high ejection frequency, ink is frequently replaced with fresh ink and it is not much necessary to circulate ink in the individual flow path 7. In a case where one individual flow path 7 includes two pressure chambers 3 like the present embodiment, even if ink is not ejected from one ejection port, ink circulation is facilitated to some extent by ejecting ink from the other ejection port.

In view of the above, in the present embodiment, based on the ejection frequency of each printing element, a condition for driving a liquid delivery mechanism 12 included in an individual flow path 7 including that printing element is adjusted. More specifically, in an individual flow path 7 including an ejection port of a high ejection frequency, ink is kept fresh near the ejection port 2 even though a liquid delivery mechanism 12 is not actively driven. Accordingly, the number of times of driving of the liquid delivery mechanism 12 in one liquid delivery operation is reduced to two or less. In contrast, in an individual flow path 7 including an ejection port of a low ejection frequency, although ink concentration and deterioration are predicted, the liquid delivery mechanism 12 is driven at a suitable timing, for example, before the next ejection operation, instead of regularly circulating ink. In this manner, stable ejection operation can be maintained without evaporating ink more than necessary.

Figure 10:
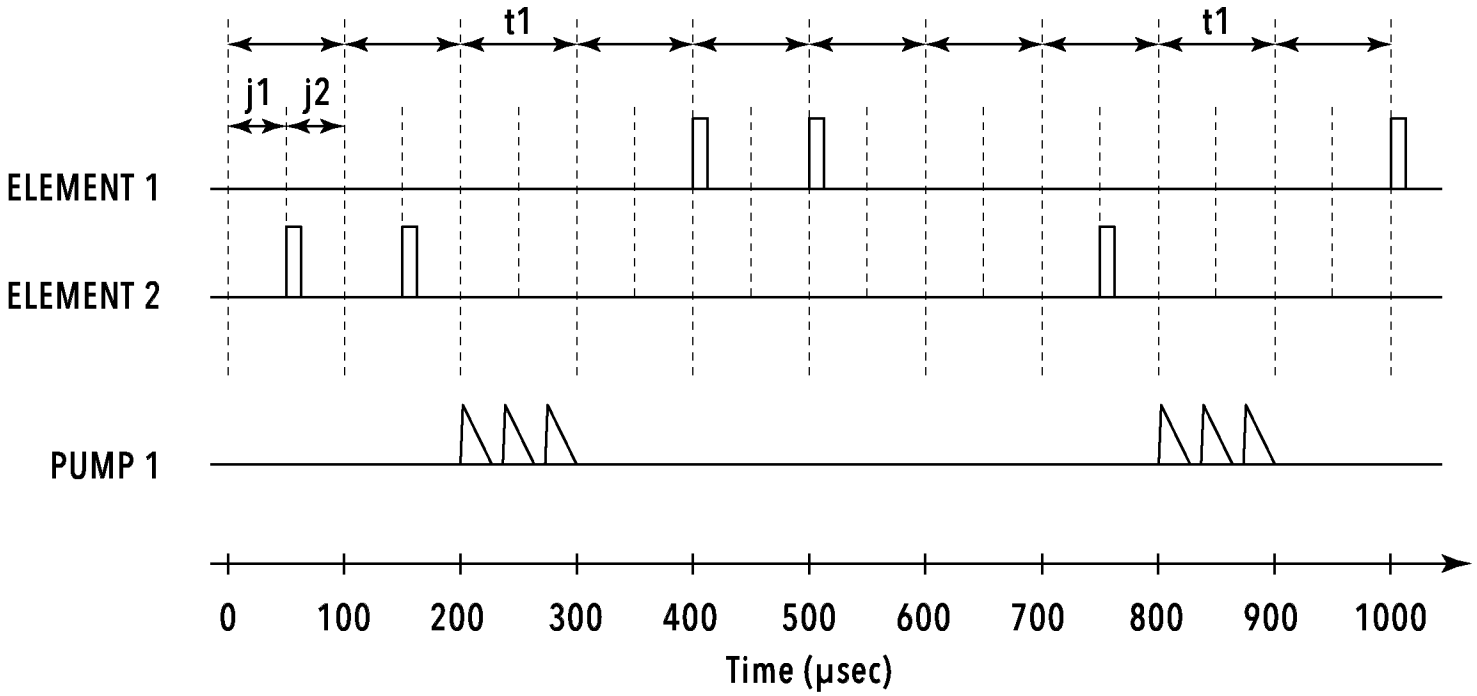
FIG. 10 is a timing chart in the case of divisional driving.

FIG. 10 is a timing chart in the case of performing divisional driving described in the first embodiment. In FIG. 10, elements 1 and 2, which are energy generating elements, and a pump 1, which is a liquid delivery mechanism, are provided in the same individual flow path 7. In the present embodiment, a unit time t allocated to one ejection operation of the energy generating element 1 is equal to a unit time t (100 μsec) allocated to one liquid delivery operation of the liquid delivery mechanism 12. The unit time t is divided into two. The first half j1 is allocated to one of the two energy generating elements 1 included in the individual flow path 7 and the second half j2 is allocated to the other.

In two printing elements included in the same individual flow path 7, liquid movement of ink caused by ejection operation of one printing element is transferred to the other printing element, which results in meniscus instability. Thus, it is preferable that the next ejection operation is performed after a time sufficient to stabilize the liquid movement caused by the ejection operation of the two printing elements. The time is about 10 to 250 μsec, depending on the dimensions and material of each element in the printing element substrate 4 and the physical properties of ink. In the present embodiment, such an interval is set to 100 μsec so that elements 1 and 2 are driven certainly with the interval of 100 μsec or more. Accordingly, in the present embodiment, the element 2, to which the second half j2 of a unit time is allocated, is not driven in a unit time after the driving of the element 1, to which the first half j1 of a unit time is allocated. Further, the element 1 is not driven in a unit time subsequent to a unit time in which the element 2 is driven. Since the liquid movement of ink makes meniscus unstable for a certain time during and after the driving of the liquid delivery mechanism 12, it is preferable that no ejection operation is performed during that time. In FIG. 10, control is exerted so that ejection operation is performed with an interval of 100 μsec or more after the driving of the liquid delivery mechanism 12.

Figure 11:
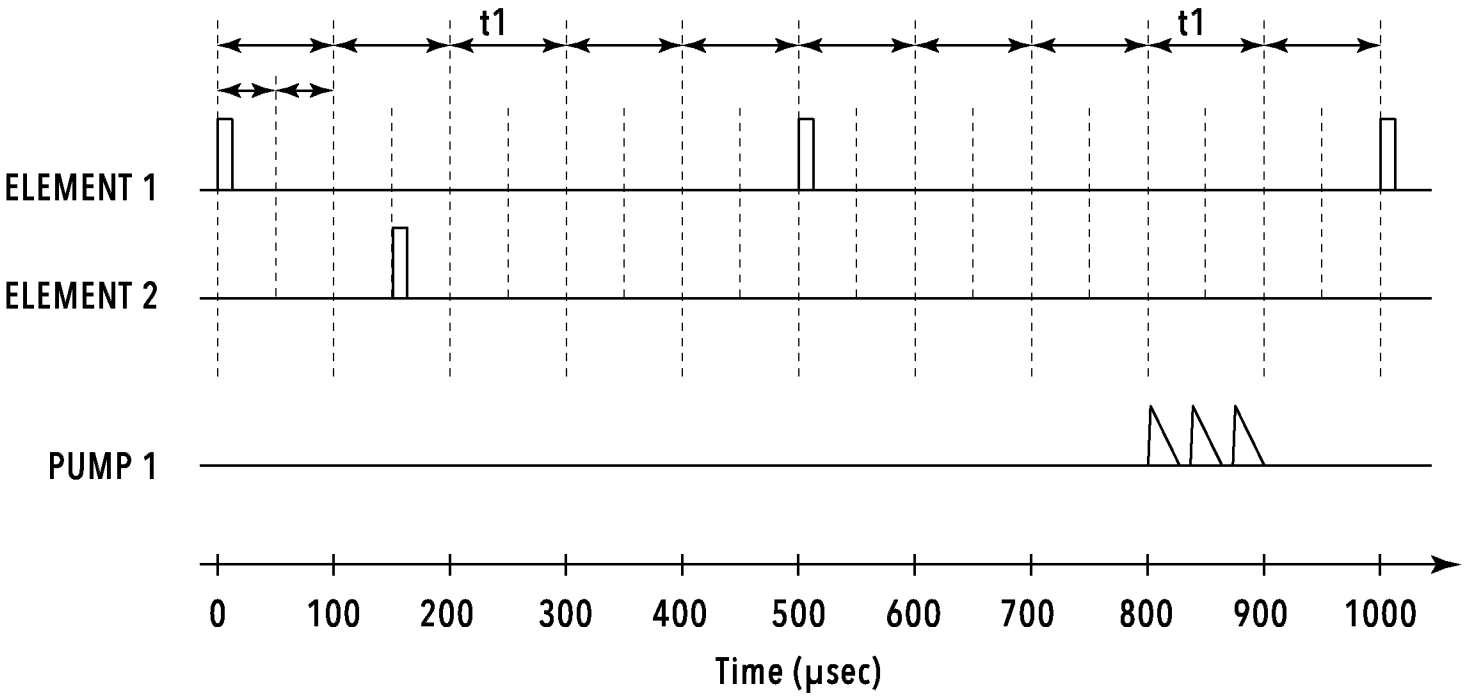
FIG. 11 is a timing chart in the case of adjusting the number of times of driving of the liquid delivery mechanism.
Figure 12:
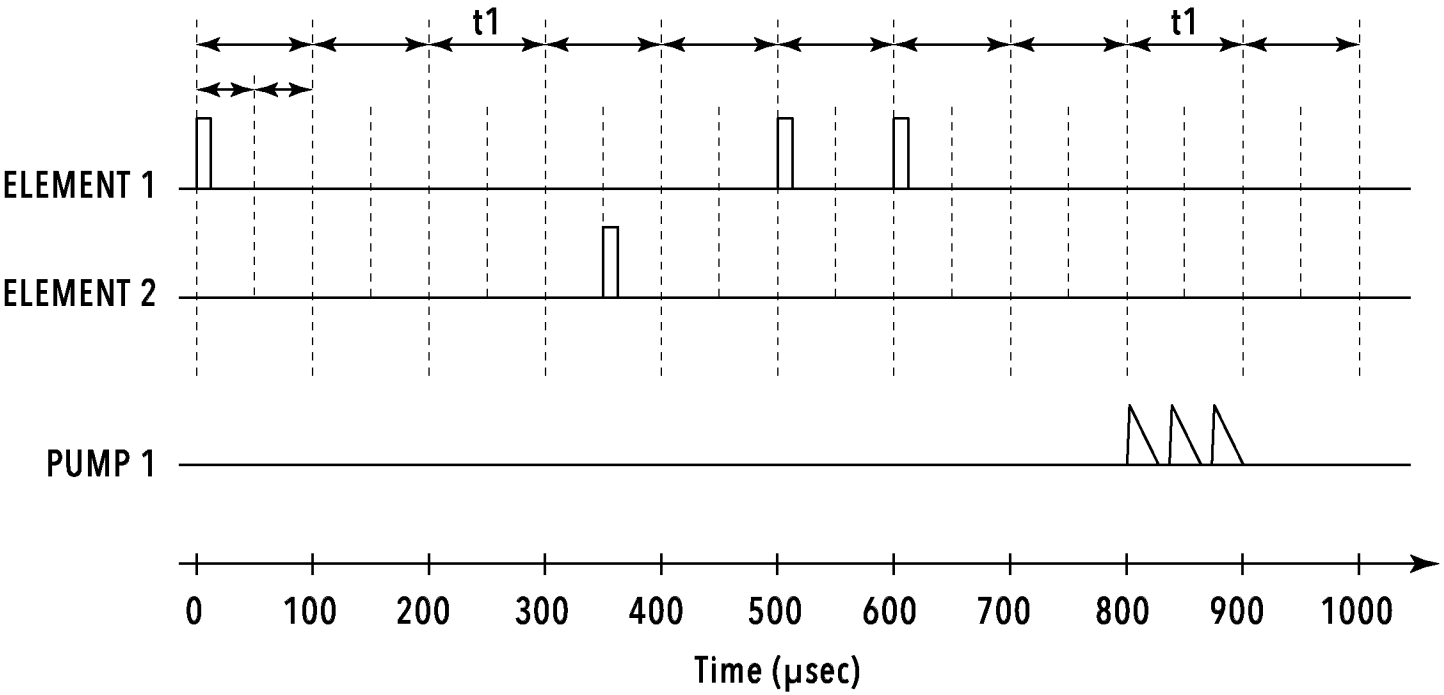
FIG. 12 is another timing chart in the case of adjusting the number of times of driving of the liquid delivery mechanism.

FIG. 11 and FIG. 12 are timing charts in the case of controlling the number of times of driving of the liquid delivery mechanism 12 based on the ejection frequencies of the printing elements. As described above, ink can be replaced with fresh ink in each ejection port by ejection operation of the ejection port. In other words, since ink has already been replaced with fresh ink in a pressure chamber 3 immediately after ejection operation, there is no need for further liquid delivery operation. In a pressure chamber 3 immediately before ejection operation, since it is clear that ink will be replaced with fresh ink soon, no liquid delivery operation is necessary unless ink concentration progressed to affect image quality at that time.

In light of the situation described above, in an example of FIG. 11, since the element 2 performs ejection operation in a unit time from 100 to 200 μsec, driving of the pump 1 is cancelled in a subsequent unit time (from 200 to 300 μsec). To be more specific, the inertia of a flow caused by ejection operation of the element 2 at 150 μsec allows the element 1 to perform normal ejection operation at 500 μsec, thereby preventing the occurrence of a problem until the next liquid delivery operation in the pump 1. Therefore, one liquid delivery operation is cancelled to avoid excessive ink circulation.

In an example of FIG. 12, since the element 2 performs ejection operation in a unit time from 300 to 400 μsec, driving of the liquid delivery mechanism 12 is cancelled in a preceding unit time (from 200 to 300 μsec). To be more specific, the element 2 can perform normal election operation at 350 μsec without liquid delivery operation in the unit time (from 200 to 300 μsec). Further, the inertia of a flow caused by the election operation allows the element 1 to perform normal ejection operation at 500 μsec and 600 μsec, thereby preventing the occurrence of a problem until the next liquid delivery operation in the pump 1. Therefore, one liquid delivery operation is cancelled to avoid excessive ink circulation. As described above, in a case where it is clear that the energy generating element 1 in the individual flow path is driven, the driving amount of the liquid delivery mechanism can be reduced in predetermined periods before and after the timing of the driving.

In FIG. 11 and FIG. 12, the number of times of driving of the liquid delivery mechanism 12 is reduced to zero to completely cancel liquid delivery operation per se. However, the number of times of driving may be reduced from three, the standard number, to two or less. Alternatively, both the methods of FIG. 11 and FIG. 12 may be used so that liquid delivery operation is cancelled if ejection operation was performed immediately before the liquid delivery operation as shown in FIG. 11 and the number of times of driving is reduced if ejection operation will be performed immediately after the liquid delivery operation as shown in FIG. 12.

The control described above can be realized by the CPU 401 referring to a table stored in the ROM 402 and changing the number of times of driving of the liquid delivery mechanism 12 based on ejection data temporarily stored in the RAM 403 (see FIG. 3). More specifically, the CPU 401 closely examines ejection data temporarily stored in the RAM 403 and, if there is data indicating ejection (1) in a unit time immediately before or after a unit time in which a liquid delivery mechanism 12 should be driven, changes the number of times of driving of the liquid delivery mechanism in the unit time in which the liquid delivery mechanism should be driven. The control may be performed together with the control based on the ambient temperature and humidity that has been already described. In this case, the numbers of times of driving of all the liquid delivery mechanisms 12 are controlled uniformly based on the ambient temperature and humidity and then controlled separately based on ejection data about each printing element.

As described above, according to the present embodiment, driving of a plurality of liquid delivery mechanisms 12 can be separately controlled based on an ejection frequency in each printing element in addition to the environment where the liquid ejecting apparatus is placed. As a result, besides the advantageous result explained in the first embodiment, it is possible to produce an advantageous result of maintaining stable ejection operation even if the environment is variously changed or the ejection ports 2 have various ejection frequencies according to image data.

(Third Embodiment)

Figure 13A:
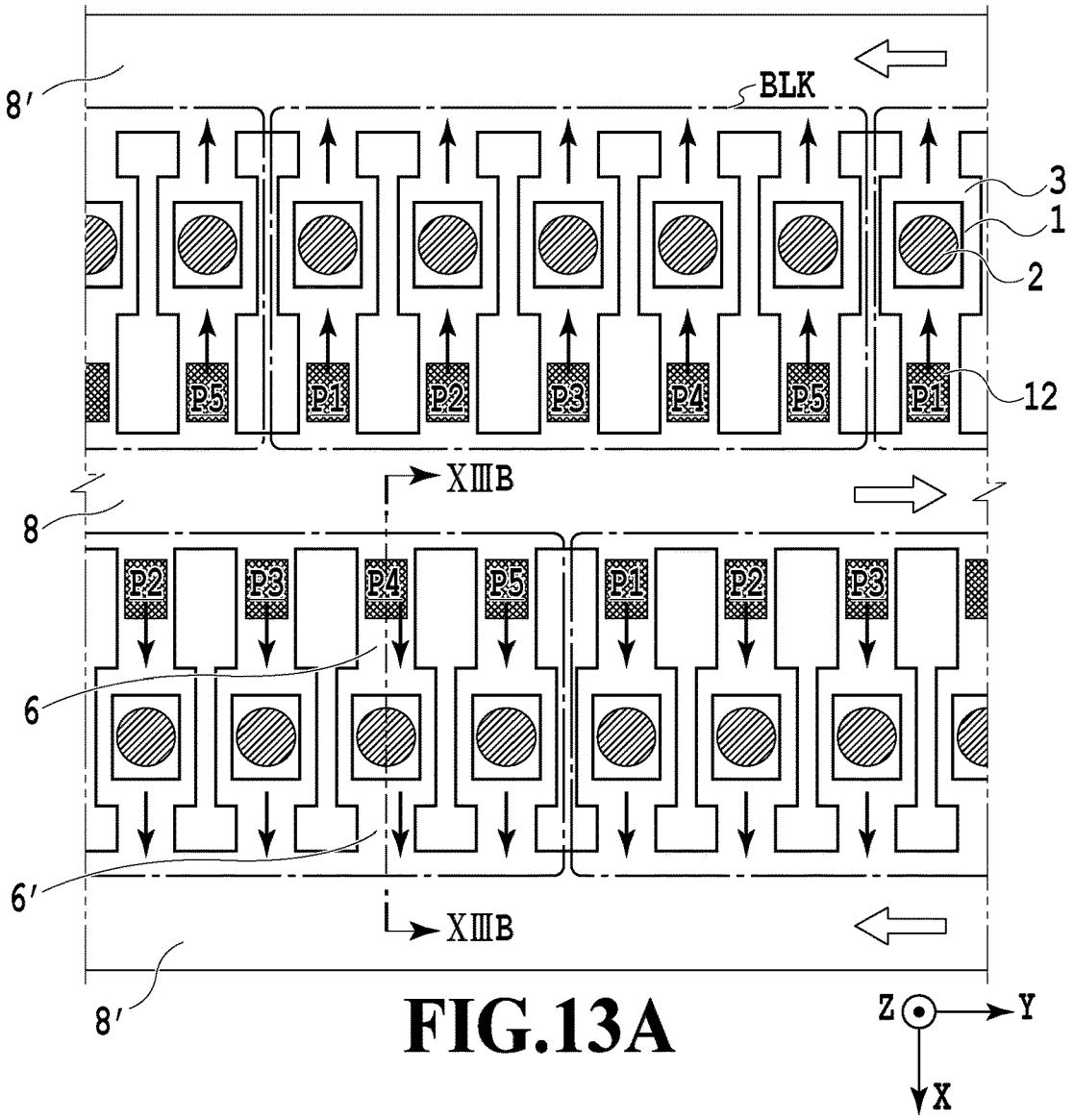
FIGS. 13A and 13B are diagrams showing a flow path configuration of a printing element substrate in a third embodiment.
Figure 13B:
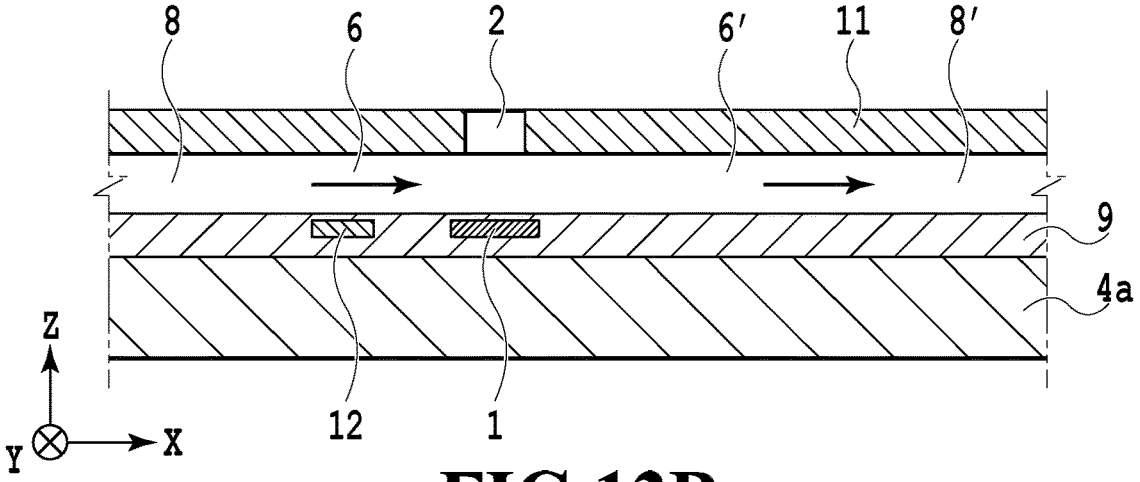

FIGS. 13A and 13B are diagrams showing a flow path configuration of a printing element substrate 4 adopted in the present embodiment. FIG. 13A is a perspective view of the printing element substrate 4 from the side of ejection ports (+Z side) and FIG. 13B is a cross-sectional view taken along line XIIIB-XIIIB. Differences between the printing element substrate of the present embodiment and that of the embodiments described above with reference to FIGS. 4A and 4B will be described below.

In the printing element substrate 4 of the present embodiment, collection flow paths 8' through which ink flows in a −Y direction are provided on both sides of a supply flow path 8 through which ink flows in the +Y direction. The supply flow path 8 is connected to the two collection flow paths 8' by a plurality of individual flow paths 7 extending in the X direction. Each individual flow path 7 has one printing element including an energy generating element 1, an ejection port 2, and a pressure chamber 3. In each individual flow path 7, a liquid delivery mechanism 12 is provided in a connection flow path 6 closer to the supply flow path 8 than the energy generating element 1.

In the present embodiment, since each individual flow path 7 includes only one printing element, liquid movement caused by ejection operation of an adjacent printing element is less than that in the embodiments described above. Therefore, drive timings for ejection can be set with a high degree of freedom without taking the effect of liquid movement into consideration.

The supply flow path 8 is connected to a first pressure room (not shown) having a pressure Ph and the collection flow paths 8' are connected to a second pressure room (not shown) having a pressure Pl lower than Ph. Consequently, ink gently flows from the supply flow path 8 to the collection flow paths 8' through the individual flow paths 7 connecting the supply flow path 8 to the collection flow paths 8' regardless of the presence or absence of the liquid delivery mechanism 12. As described above, in the present embodiment in which ink regularly flows through the individual flow paths 7, ink concentration in the pressure chambers 3 can be further suppressed and the number of times of driving of the liquid delivery mechanisms 12 can be further reduced as compared with the embodiments described above.

Further, the liquid delivery mechanism 12 is provided in the connection flow path 6 connecting the supply flow path 8 to the pressure chamber 3 and the flow path resistance of the connection flow path 6 is less than that of the connection flow path 6' connecting the collection flow paths 8' to the pressure chamber. Accordingly, the ink flow from the supply flow path 8 to the collection flow paths 8' can be further facilitated by driving the liquid delivery mechanisms 12. Although various liquid delivery mechanisms can be used as the liquid delivery mechanism 12 like the embodiments described above, a case of using a piezoelectric actuator will be described below.

Specific examples of the dimensions of the above structure are explained below. The size of the energy generating element 1 is 20 μm×25 μm, the diameter of the ejection port 2 is 20 μm, and the area of the pressure chamber 3 is 25 μm×30 μm. The width of the connection flow paths 6 and 6' is 25 μm. The length of the upstream connection flow path 6 is 40 μm and the length of the downstream connection flow path 6' is 20 μm. The height of the whole of the individual flow path 7 is 15 μm. The width of the supply flow path 8 and collection flow path 8' is 40 μm, the thickness of the ejection port forming member 11 is 12 μm, and a pressure difference Ph-Pl between the pressure Ph created by the first pressure room connected to the supply flow path 8 and the pressure Pl created by the second pressure room connected to the collection flow path 8' is 0 to 100 mmAq. The viscosity of ink to be used is 3 cP and the amount of ink ejection from each ejection port is 7 pl. It is preferable that the pressure difference Ph-Pl is properly adjusted based on the temperature and humidity of a use environment, that is, an ink evaporation rate.

In each of the printing element arrays located on both sides of the supply flow path 8, a plurality of printing elements are arrayed in the Y direction at a density of 600 dpi. The two printing element arrays are shifted from each other by half the pitch in the Y direction. In the present embodiment, a plurality of printing element substrates 4 each having the array shown in FIG. 13A are arranged in the Y direction to form a full line type print head 100 capable of printing an image on an A4 print medium at a resolution of 1200 dpi.

In the present embodiment, five liquid delivery mechanisms 12 adjacent to each other in the Y direction (that is, five consecutive printing elements) are regarded as one block. The printing elements and liquid delivery mechanisms 12 are divided into a plurality of blocks and controlled. At this time, the boundaries between adjacent blocks in one printing element array are shifted from those in the other by half the pitch. The five liquid delivery mechanisms 12 are driven in the order of P1 (pump 1), P2 (pump 2), P3 (pump 3), P4 (pump 4), and P5 (pump 5) like the embodiments described above.

Figure 14:
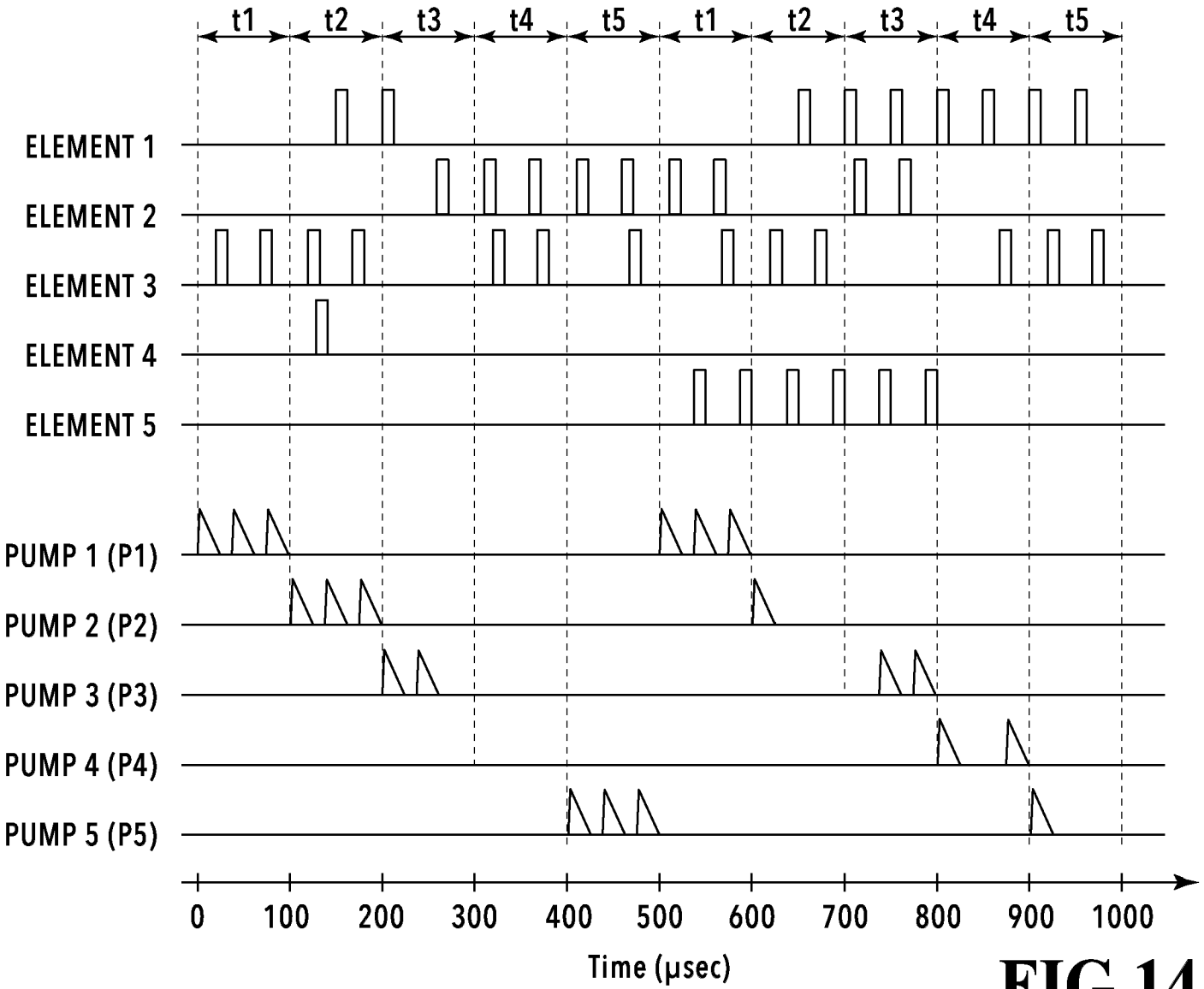
FIG. 14 is a timing chart in the third embodiment.

FIG. 14 is an example of a timing chart of block driving in the present embodiment. FIG. 14 shows drive pulses applied to five energy generating elements (element 1 to element 5) included in the same block and driving states of five liquid delivery mechanisms (pump 1 to pump 5). Also in the present embodiment, liquid delivery operation of driving a liquid delivery mechanism three times in 100 μsec illustrated in FIG. 5 is basically performed for the pump 1 to pump 5 (P1 to P5) in sequence. In addition, in the present embodiment, driving of the liquid delivery mechanisms 12 is further controlled for each individual flow path 7.

Also in the present embodiment, driving of the liquid delivery mechanisms 12 is adjusted based on ejection data before and after unit times t allocated to respective liquid delivery mechanisms 12 like the second embodiment described with reference to FIG. 11 and FIG. 12. Detailed description will be provided below with reference to FIG. 14.

In FIG. 14, an element 1 (energy generating element) and a pump 1 (liquid delivery mechanism) are provided in the same individual flow path 7, and the same goes for an element 2 and a pump 2, an element 3 and a pump 3, an element 4 and a pump 4, and an element 5 and a pump 5. In a case where each pump is driven, an element provided in an individual flow path 7 including the pump is not driven. For example, the element 1 is not driven in a unit time t1 in which the pump 1 is driven. In a case where ejection data exists in that pixel position (that timing of that element), ejection operation is performed by another printing element capable of printing in the same pixel position. In addition, the number of times of driving of each pump is changed based on ejection data before and after a unit time in which the pump is driven.

For example, regarding a unit time t2 from 600 to 700 μsec in which the pump 2 is driven, the element 2 performs ejection operation in both of a unit time t1 immediately before the unit time t2 and a unit time t3 immediately after the unit time t2 and it is possible to predict that a pressure chamber 3 stores flesh ink. Thus, the number of times of driving is changed from three, the normal number, to one to avoid excessive ink circulation.

Regarding a unit time t5 from 400 to 500 μsec in which the pump 5 is driven, the element 5 performs ejection operation in a unit time t1 immediately after the unit time t5 but no ejection operation is performed for some time including a unit time t4 immediately before the unit time t5. Since there is a possibility of ink concentration in the pressure chamber 3, driving is performed three times as usual to replace ink with fresh ink.

Regarding the unit time t4 from 300 to 400 μsec in which the pump 4 is driven, no ejection operation is performed by the element 4 for some time including the unit time t3 immediately before the unit time t4 and it is therefore conceivable that ink in the pressure chamber 3 is concentrated to some extent. On the other hand, no ejection operation is performed by the element 4 for some time including the unit time t5 immediately after the unit time t4. Thus, there is no possibility of image deterioration caused by ejection of concentrated ink. Accordingly, it is determined that there is little need to supply flesh ink to the pressure chamber at this timing and the driving of the pump 4 is cancelled to avoid excessive ink circulation. It should be noted that, in the next unit time t4 from 800 to 900 μsec, driving is performed twice intermittently to prevent the liquid delivery function of the pump from being impaired by excessive ink concentration.

As described above, in a case where each individual flow path 7 includes one liquid delivery mechanism 12 and one printing element, driving of the liquid delivery mechanisms 12 can be adjusted separately and closely based on ejection data about the corresponding printing elements 1 to 5.

Figure 15:
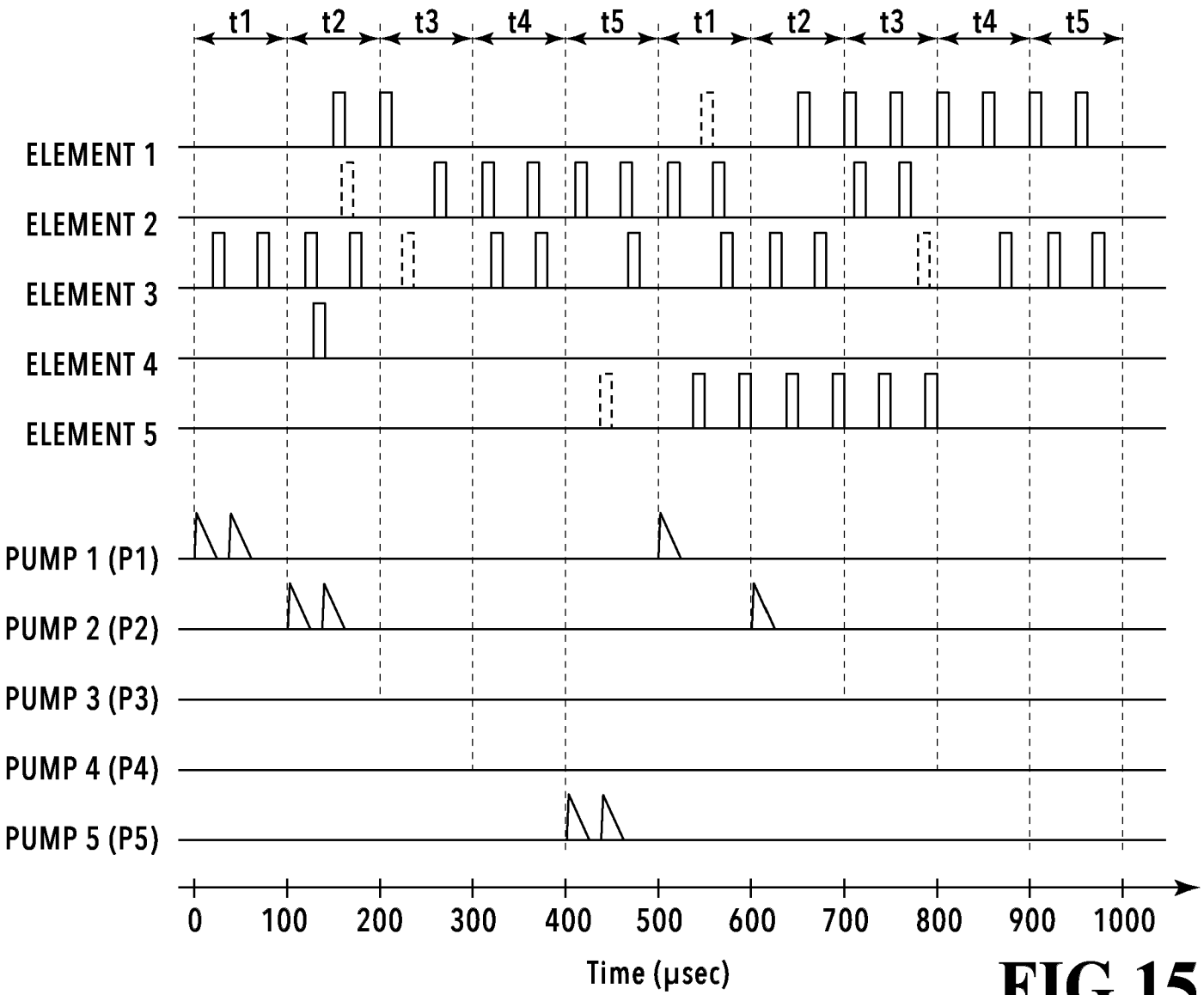
FIG. 15 is another example of the timing chart in the third embodiment.

FIG. 15 is another example of the timing chart of block driving in the present embodiment. FIG. 15 is different from FIG. 14 in that preliminary ejection operation is used as a method for replacing concentrated ink with flesh ink in addition to the liquid delivery operation. In FIG. 15, drive pulses to be applied to elements 1 to 5 for the preliminary ejection operation are shown by broken lines.

The preliminary ejection operation means ejection operation that is preliminary and is irrelevant to ejection data based on image data. In a state where no ejection data exists for a while and ink concentration progresses, the ejection state of a printing element can be stabilized by performing the preliminary ejection operation at a proper timing. Further, since deteriorated ink is discharged from the circulation flow path, the preliminary ejection operation is also preferable for stabilization of the degree of concentration in the entire circulation flow path.

Since the preliminary ejection operation only requires that concentrated ink be discharged, there is no need to ensure the same ejection quality as that in ejection operation based on image data. The preliminary ejection operation in the present embodiment is therefore performed in the same unit time as the liquid delivery operation. However, in a full line type inkjet printing apparatus like the present embodiment, the preliminary ejection operation in printing operation is performed for an image on a print medium. Accordingly, it is preferable that the preliminarily ejection is performed on a condition that, for example, an area has a high density, so that deterioration in image quality is not recognized even if a dot irrelevant to the image is printed. Detailed description will be provided below with reference to FIG. 15.

Regarding the element 1, ejection data based on image data does not exist from 220 to 650 μsec and ink concentration is predicted. Thus, the pump 1 is driven once and preliminary ejection is performed once in a unit time t1 immediately before ejection at 650 μsec.

Regarding the element 2, ejection data based on image data does not exist from 0 to 250 μsec and ink concentration is predicted. Thus, the pump 2 is driven twice and preliminary ejection is performed once in a unit time t2 immediately before ejection at 250 μsec.

Regarding the element 3, ejection data based on image data appears relatively frequently and the possibility of ink concentration is low. Thus, liquid delivery operation is cancelled and preliminary ejection is performed once in a unit time t3.

Regarding the element 4, although ejection data based on image data is few and ink concentration is predicted, concentrated ink is not ejected based on image data either. Thus, liquid delivery operation is cancelled and no preliminary ejection is performed in a unit time t4.

Regarding the element 5, ejection data based on image data does not exist from 0 to 550 μsec and ink concentration is predicted. Thus, the pump 5 is driven twice and preliminary ejection is performed once in a unit time t5 immediately before ejection at 550 μsec.

As described above, concentration of circulating ink can be reduced as a whole while maintaining a stable ejection state in each printing element by the use of the preliminary ejection operation as a method for replacing concentrated ink with flesh ink in addition to the liquid delivery operation.

(Fourth Embodiment)

Figure 16A:
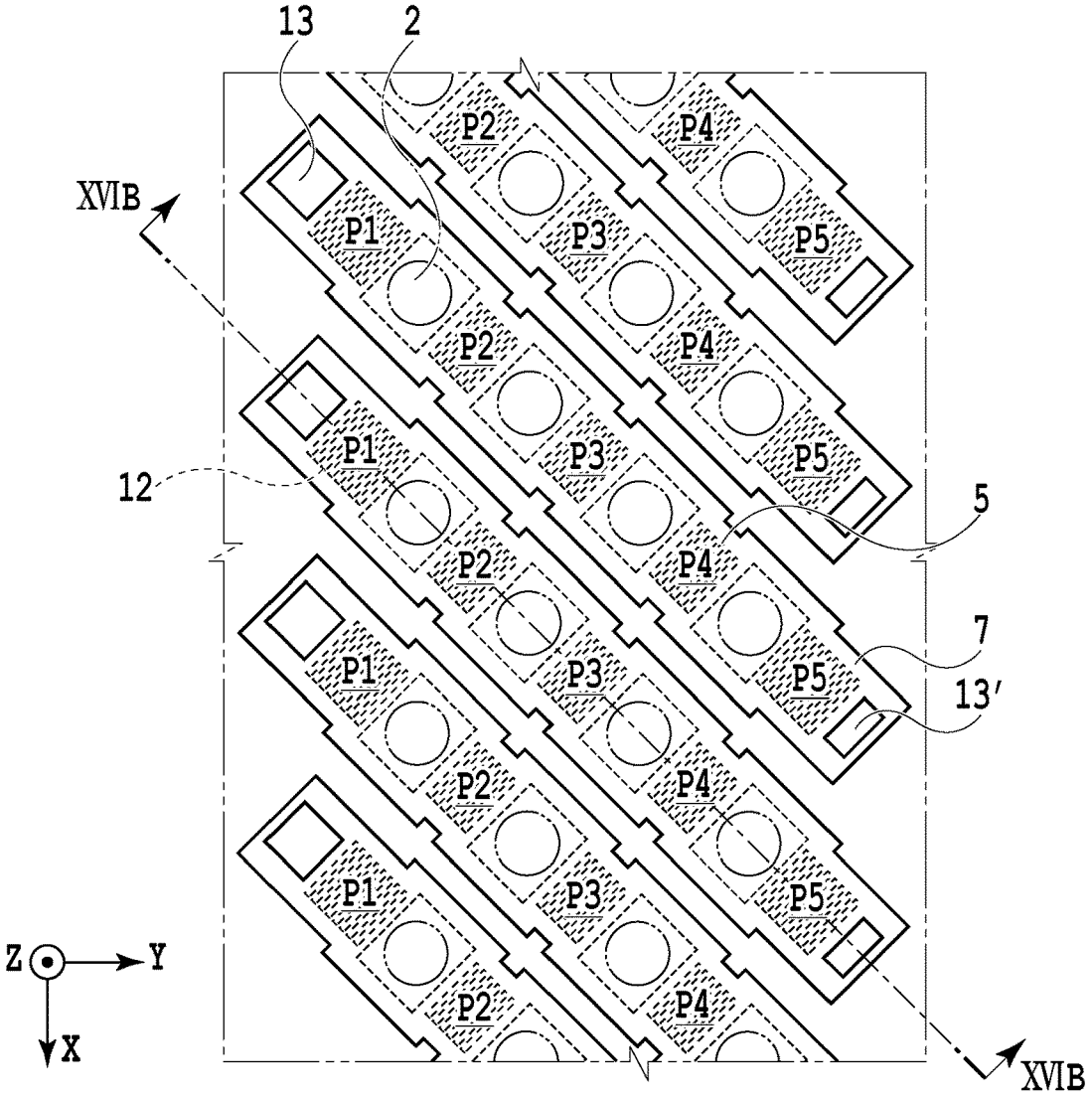
FIGS. 16A and 16B are diagrams showing a flow path configuration of a printing element substrate in a fourth embodiment.
Figure 16B:
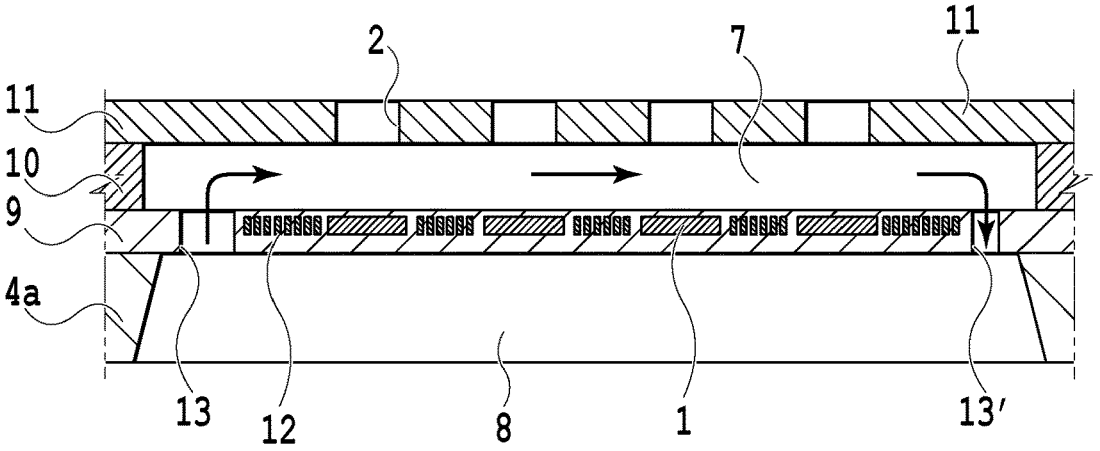

FIGS. 16A and 16B are diagrams showing a flow path configuration of a printing element substrate 4 adopted in the present embodiment. FIG. 16A is a perspective view of the printing element substrate 4 from the side of ejection ports (+Z side) and FIG. 16B is a cross-sectional view taken along line XVIB-XVIB.

As shown in FIG. 16B, a supply flow path 8 of the present embodiment is formed as an opening penetrating a silicon substrate 4*a* and is connected to an individual flow path via an inlet 13 and an outlet 13' that are formed in a functional layer 9. As shown in FIG. 16A, a plurality of individual flow paths 7 are formed in parallel in a direction inclined with respect to the Y direction. In each individual flow path 7, four printing elements and five liquid delivery mechanisms 12 are alternately arranged in a line.

The inlet 13 and the outlet 13' are provided on respective ends of each individual flow path 7. An ink flow shown by arrows in FIG. 16B is created by a difference in flow path resistance between the inlet and outlet and driving of five liquid delivery mechanisms 12. More specifically, ink flows from the supply flow path 8 through the inlet 13, passes through four pressure chambers 3, and then flows into the supply flow path 8 through the outlet 13'. Although various configurations can be used for the liquid delivery mechanism 12 in the present embodiment, an alternating current electro-osmotic (ACEO) pump is adopted in the present embodiment.

Figure 17:
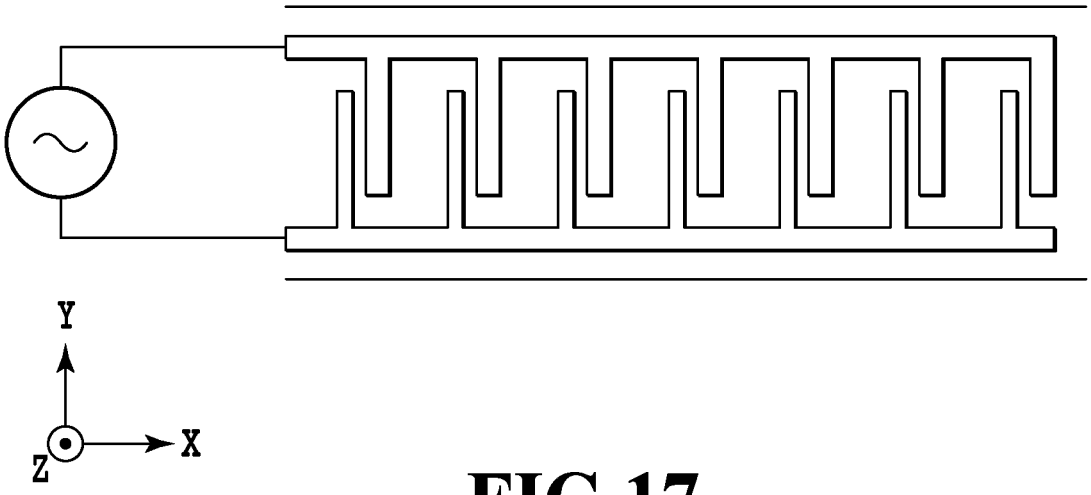
FIG. 17 is a plan view of an alternating current electroosmotic (ACEO) pump.

FIG. 17 is a plan view of the ACEO pump. Two groups of comb-like electrodes have different widths and heights and are interdigitally arranged. An AC voltage is applied between the electrodes, thereby producing an asymmetric electric field in liquid located above the electrodes and causing the liquid to flow in a desired direction. The ACEO pump is suitable for a case where an individual flow path 7 has a relatively long length and extends in one direction like the present embodiment.

Specific examples of the dimensions of the above structure are explained below. The size of the energy generating element 1 is 18 μm×22 μm, the diameter of the ejection port 2 is 18 μm, and the area of the pressure chamber 3 is 25 μm×30 μm. A communication flow path 5 interposed between the pressure chambers 3 has a width of 18 μm and a length of 7 μm. The opening area of the inlet 13 is 10 μm×15 μm, the opening area of the outlet 13' is 5 μm×15 μm, and the height of the whole of the individual flow path 7 is 12 μm. The width of the supply flow path 8 is 250 μm and the thickness of the ejection port forming member 11 is 10 μm. The viscosity of ink to be used is 3 cP and the amount of ink ejection from each ejection port is 4 pl.

In the present embodiment, five consecutive liquid delivery mechanisms 12 and four energy generating elements 1 included in each individual flow path 7 are regarded as one block and block driving is performed in the same manner as the embodiments described above. At this time, five liquid delivery mechanisms 12 included in the same individual flow path 7 may be sequentially driven from P1, but a plurality of liquid delivery mechanisms 12 may be driven at the same timing. For example, P2 and P4 may be driven together after driving P1, P3, and P5 together.

Also in the present embodiment described above, stable ejection operation can be maintained while reducing the ink evaporation amount as a whole to avoid ink deterioration as well as reducing the power supply capacity and the possibility of noise, like the embodiments described above.

MODIFIED EXAMPLES

The structures and control methods of the printing element substrate described in the above embodiments can be modified, combined with each other, and replaced with each other. For example, the individual flow path 7 shown in FIG. 4A may include more printing elements and liquid delivery mechanisms 12. In this case, the liquid delivery mechanisms 12 may have different strengths and frequencies of driving according to their positions in the individual flow path. However, as the number of pressure chambers 3 or liquid delivery mechanisms included in one individual flow path 7 increases, the individual flow path 7 itself becomes larger. In consideration of the effect of ejection operation in an upstream printing element on ejection operation in a downstream printing element, the number of pressure chambers provided in one individual flow path 7 may be about 10 at most and preferably be five or less.

Further, pumps in the same block should not necessarily be driven in the order of P1 to P6 as shown in FIG. 7 and may be driven in the order of P6 to P1 or other orders. Furthermore, although the standard number of times of driving of liquid delivery mechanisms in one liquid delivery operation is three in the above description, it may be variously adjusted and may be two or less or four or more.

The first and second embodiments show the configuration in which a plurality of individual flow paths are allocated to one block and the fourth embodiment shows the configuration in which one individual flow path is allocated to one block. However, the present invention may be modified to include a plurality of blocks in one individual flow path. For example, this corresponds to the case of driving P1, P3, and P5 together and then driving P2 and P4 together in the configuration shown in FIG. 16A.

In the description of the third embodiment with reference to FIG. 15, the preliminary ejection operation is performed to discharge concentrated ink near the ejection ports. However, this may be replaced with or combined with an aspect of applying energy to the energy generating element 1 below a level at which ejection operation is performed. In this case, although concentrated ink is not discharged, the meniscus in the ejection ports is vibrated, thereby stirring concentrated ink inside the pressure chambers.

Further, in the above embodiments, a pressure difference produced by an unshown pump is used to control fluid pressures in the supply flow path 8 and collection flow path 8'. However, the present invention is not limited to this. For example, an ink flow may be produced by the use of capillary action or a difference in hydraulic head between upstream and downstream ink tanks.

Further, the full line type print head having printing element substrates 4 arrayed by a distance corresponding to the width of a print medium has been described as an example with reference to FIG. 1. However, the flow path configurations of the present invention may also be applied to a serial type print head. It should be noted that an elongated print head such as a full line type print head can attain the advantageous result of the present invention more conspicuously because the problem to be solved by the present invention, that is, ink evaporation and deterioration, occurs more frequently in such a print head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-127569 filed Jun. 29, 2017, which is hereby incorporated by reference herein in its entirety.

What is claimed is:

1. An ink ejecting apparatus comprising:

a plurality of pressure chambers which store ink;

a plurality of energy generating elements, each energy generating element being provided in a position corresponding to one of the pressure chambers and providing energy to ink in the pressure chamber;

a plurality of ejection ports, each ejection port being provided in a position corresponding to one of the energy generating elements and from which ink provided with energy from the energy generating element is ejected;

a plurality of liquid delivery mechanisms, each liquid delivery mechanism being located upstream of at least one of the energy generating elements with respect to a flow of ink, being prepared in association with at least one of the pressure chambers, and facilitating the flow of ink through the at least one pressure chamber; and a control unit configured to control driving of the plurality of the liquid delivery mechanisms, wherein the control unit divides the plurality of the liquid delivery mechanisms into a plurality of blocks to drive the liquid delivery mechanisms, which are included in each of the blocks, at different timings.

2. The ink ejecting apparatus according to claim 1, wherein the plurality of the liquid delivery mechanisms are arrayed on the same plane as the plurality of the energy generating elements, and the liquid delivery mechanisms that are simultaneously driven by the control unit are dispersed uniformly on the plane.

3. The ink ejecting apparatus according to claim 1, wherein in a case in which a flow rate in a flow path which is common to the plurality of the pressure chambers and supplies ink to the plurality of the pressure chambers increases, the control unit reduces the driving amounts of the plurality of the liquid delivery mechanisms.

4. The ink ejecting apparatus according to claim 1, wherein the control unit changes the driving amounts of the plurality of the liquid delivery mechanisms based on at least one of an ambient temperature and an ambient humidity.

5. The ink ejecting apparatus according to claim 1, wherein the control unit changes the driving amounts of the plurality of the liquid delivery mechanisms based on a temperature of a substrate on which the plurality of the energy generating elements are provided.

6. The ink ejecting apparatus according to claim 1, wherein based on ejection data for driving the energy generating elements, the control unit individually changes the driving amount of the liquid delivery mechanism corresponding to each of the energy generating elements.

7. The ink ejecting apparatus according to claim 6, wherein for a predetermined period before or after one of the energy generating elements is driven, the control unit reduces the driving amount of the liquid delivery mechanism corresponding to the energy generating element.

8. The ink ejecting apparatus according to claim 6, wherein the control unit generates new ejection data for driving the energy generating elements based on the ejection data for driving the energy generating elements to eject ink from the ejection ports and reduces the driving amount of the liquid delivery mechanisms corresponding to the energy generating elements.

9. The ink ejecting apparatus according to claim 1, wherein the control unit changes the driving amount of the liquid delivery mechanisms by adjusting at least one of the number of times of driving and a driving period of the liquid delivery mechanisms in a unit time.

10. The ink ejecting apparatus according to claim 1, wherein the liquid delivery mechanisms and the pressure chambers associated with the liquid delivery mechanisms are arranged in a line in a direction of a flow of ink in the same flow path.

11. The ink ejecting apparatus according to claim 1, wherein one liquid delivery mechanism is prepared for each of the pressure chambers.

12. A control method of an ink ejecting apparatus, the ink ejecting apparatus comprising:

a plurality of pressure chambers which store ink;

a plurality of energy generating elements, each energy generating element being provided in a position corresponding to one of the pressure chambers and providing energy to ink in the pressure chamber;

a plurality of ejection ports, each ejection port being provided in a position corresponding to one of the energy generating elements and from which ink provided with energy from the energy generating element is ejected; and a plurality of liquid delivery mechanisms, each liquid delivery mechanism being located upstream of at least one of the energy generating elements with respect to a flow of ink, being prepared in association with at least one of the pressure chambers, and facilitating the flow of ink through the at least one pressure chamber, wherein the plurality of the liquid delivery mechanisms are divided into a plurality of blocks and the liquid delivery mechanisms included in each of the blocks are driven at different timings.

* * * * *